US005553457A

United States Patent [19]

Reznikov

[11] Patent Number: 5,553,457

[45] Date of Patent: Sep. 10, 1996

[54] COOLING DEVICE

[76] Inventor: Lev Reznikov, 1510 Ocean Pky., #A17, Brooklyn, N.Y. 11230

[21] Appl. No.: 314,767

[22] Filed: Sep. 29, 1994

[51] Int. Cl.[6] ..... F25B 41/00

[52] U.S. Cl. ..... 62/81; 62/198; 62/526

[58] Field of Search ..... 62/198, 525, 526, 62/81, 278

[56] References Cited

U.S. PATENT DOCUMENTS

| | | | |
|---|---|---|---|
| 2,791,099 | 5/1957 | Jordan | 62/198 |
| 4,227,379 | 10/1980 | Oonishi | 62/198 |
| 4,389,854 | 6/1983 | Ogita et al. | 62/198 X |
| 4,741,178 | 5/1988 | Fujiu et al. | 62/198 X |
| 4,918,936 | 4/1990 | Sakamoto | 62/198 X |

*Primary Examiner*—William E. Tapolcai
*Attorney, Agent, or Firm*—Ilya Zborovsky

[57] ABSTRACT

A method of producing a higher temperature cold and a lower temperature cold comprises the steps of generating a higher temperature cold and a lower temperature cold each including a compression of vapors of refrigerant condensation of the compressed vapors and subsequent expansion of the refrigerant with accompanying cooling, accumulating the generated colds, supplying the generated colds to corresponding consumers of higher temperature cold and lower temperature cold, and performing the generating, the accumulating and the supplying of the lower temperature cold at a second auxiliary stage during periods of reduced demand in the higher temperature cold generated at a first stage.

3 Claims, 13 Drawing Sheets

COOLING DEVICE

BACKGROUND OF THE INVENTION

The present invention relates to a cooling device. More particularly, it relates to a cooling device which can be utilized by a consumer who needs to use low temperature at two or more temperature levels. For example it can be used for cooling of vegetable storage facility which needs high temperature cooling level from 0° to −5° C., low temperature cooling level for a freezer from −25° C.—40° C., and average temperature cooling level for a cooling chamber of the vegetable storage from −2°—10° C.

Freon compression cooling machines and installations are widely used for producing cold in the above mentioned temperature ranges. Such installations include a compressor for compressing a refrigerant, a condenser formed as a surface heat exchanger for cooling and condensing of the compressed refrigerant preferably due to thermal contact with cooling media such as atmospheric air or water, evaporator of the liquefied refrigerant at a low pressure corresponding to the pressure of compressor suction which determines the equilibrium temperature of boiling of the refrigerant and corresponding temperature of the object to be cooled (cooling chamber, space, etc.), and also throttling device for reducing the refrigerant pressure from the condensation pressure (pumping) to the evaporation pressure (suction). The throttling devices are usually formed as fixed local hydraulic resistances (such as for example portions of capillary pipes arranged in a line which connects the condenser with the evaporator), or regulatable hydraulic resistances which can be formed as throttle manual valve or driven throttle valves (thermo-regulating, electro-driven) in systems with automatic thermo-regulation of cooling area with the use of the circuits with a feedback and amplification. For cooling within the above mentioned temperature levels, unified compressor-condenser aggregates can be used as well as identical refrigerants, for example R 22. Differences in mode of operation and as a result different temperatures of boiling of refrigerant in evaporators are provided first of all by differences in hydraulic resistances of throttling devices, and secondly by different ratios of heat exchange surfaces of evaporators and objects to be cooled as well as thermal inflows into the systems. Most frequently in order to produce cold at different temperature levels separate cooling devices are utilized. This is not always convenient and advisable in view of technological and economical reasons, especially when the demand for low temperature level cold is not great and is needed only periodically.

The known system for cooling at two temperature levels contains, in addition to the joint compressor-condenser aggregate also a distributor of liquid refrigerant after the condenser, two evaporators with different cooling chambers, and a collector connecting the flows of refrigerant vapors after the evaporators before their return to the compressor suction. An additional hydraulic resistance is arranged in the return line of vapors from the evaporator of high temperature chamber between the exit from the evaporator and the collector. Thereby the pressure in this evaporator is established at the higher level than the suction level and the corresponding pressure in the low temperature evaporator. Therefore the temperature of refrigerant boiling in the evaporator with the additional throttling device at the exit from it is established at the higher level. An increase in the value of hydraulic resistance of the additional throttle leads to the proportional increase of the pressure jump at it and the temperature increase in the corresponding section of the cooling device. The distributor of the liquid refrigerant separates its flow for parallel evaporators proportionally to the cooling efficiency at each temperature level. The disadvantage of this circuit is its low energy efficiency due to high thermo-dynamic irreversibility of processes in the branch with the additional throttle. The result of this irreversibility is low technological and economical characteristics of the system as a whole. The compressor compresses the whole flow of refrigerant in the pressure intervals corresponding to the temperature differential required for producing the low temperature cooling, and this differential and pressure corresponding to it is used only in one section. The efficiency of such systems is especially low when the demand for low level cooling with respect to the quantity of high level cooling is low. In practice such ratios are more probable. For example, cooling efficiency of devices at the refrigerant boiling temperature 0° to 10° C. can exceed the cooling efficiency of freezers 10–30 times. Therefore, it is considered to be inefficient to combine in a single device of cascadeless type (with one stage compressor) the functions of generation of cooling with high and low levels. The second reason of difficulties to provide efficient systems of this type is uncorrelating schedules of demands for cooling at different temperature levels. The cascade multi-compressor cooling devices used in praxis for producing cooling at two or more temperature levels are complicated, cumbersome, expensive, and their reliability is relatively low.

A substantial disadvantage of cooling device which generate cooling at the level of −5°—50° C. and used for storage of some wet products (for example bulk meat, fish, vegetables, etc.), as well as for air cooling below 0° C., is freezing of ice and frost layer on heat exchanging surfaces of evaporators. Frost thermally insulates the surfaces of the heat exchanger ribs, reduces the heat exchanging surface and leads to the reduction of cooling efficiency, increases electrical energy consumption, reduction of suction pressure and increase of compression degree of the compressor, its overheating and excessive wear if melting is performed not sufficiently frequently. The process of melting is time consuming, and during the melting period the cooling chamber is subjected to undesirable heating. Cold accumulated by deposits of ice and frost not only is not used, but additional energy is wasted for its removal. During the use of heated vapors of compressed refrigerant for heating and melting the compressor operates idly.

Existing constructions for cooling such objects as standard cans and containers for beverages also have substantial disadvantages which make difficult or impossible the task of fast cooling to the level of environmental temperature. Known coolers are usually cooling chambers with the interior temperature of −5°—30° C.

Heat withdrawal from the objects is performed through passive, little movable air layer. The main mechanism of heat transfer is a natural air convection. For these conditions very low heat exchange efficiency is available. The level of frost on the surface of the evaporator additionally worsens the heat exchange. Masses and sizes of elements on equipment to be cooled are many times higher than the sizes of objects to be cooled, the walls of cooling chamber are cooled faster to minimal temperatures than the objects to be cooled, and despite the high thickness of thermal insulation, cooling losses exceed the cold which is used efficiently while the time of cooling reaches hours. The same reasons make difficult the preparation of small quantities of food ice as well as accumulation of cold in small autonomous mobile isotherming storage chambers. The absence of control of current temperature of the objects to be cooled directly leads to substantial deviations of real temperature from the given magnitude.

SUMMARY OF THE INVENTION

Accordingly, it is an object of the present invention to provide a cooling device which avoids the disadvantages of the prior art.

More particularly, it is an object of the present invention to eliminate the above mentioned disadvantages by providing a cooling cycle, system and construction of cooling devices and their aggregates based on a one stage compressor, which ensures production and accumulation of cold at two and more temperature levels.

In accordance with one specific feature of the present invention a possibility of alternative switching and changing of modes of operation of a cooling device for generation of cooling at different temperature levels is provided. Continuous, uninterrupted supply of consumers with cold is obtained by accumulation of cold at each temperature level with the use of additional cold accumulating media, with temperature of their phase transformations corresponding to the working levels of temperatures of cold consumers at each temperature level.

In order to transmit cold from the evaporating refrigerant to refrigerating media, processes of phase transformations of cold accumulating and heat transmitting additional media which use the modes of unidirectional cold or heat transfer can be utilized, for example the mode of a thermal diode, a thermal key, etc. Changes of a temperature level of generated cooling are obtained by discrete change of hydraulic resistance of the throttling device during production of cold by a compression cooling device. For periodic production of portions of low temperature cooling it is also advisable to use liquid refrigerant which is accumulated in a throughgoing part of the main stage of production of high level cold. When the temperature of object cooled at the first stage is achieved, supply of refrigerant from condensor to evaporation is interrupted, while continuing pumping out of refrigerant vapors by the compressor. Simultaneously the low temperature evaporator of the second cooling stage located below the evaporator of the first cooling stage is connected with the above mentioned evaporator of the first cooling stage. During pumping out of vapors the boiling temperature and the pressure refrigerant in the evaporator of the second stage and the temperature of the objects to be cooled are reduced. The pumping out of vapors is interrupted when the desired level of cooling temperature is reached or the suction pressure is reduced below the limit level. The pressure is reduced to the limit pressure due to the reaching of the given temperature level or complete evaporation of the whole refrigerant at the second level.

The low temperature section formed as a self-contained circulating circuit including an evaporator of low pressure and receiver-separator of refrigerant is connected for liquid and gas with the high temperature circuit of the section of air conditioning located above. When the conditioning mode is finished and the throttle is closed, the pressure in the system is reduced, the inflow of refrigerant in the evaporators is diminished or interrupted. The quantity of liquid in the evaporators connected with one another is sufficient from filling the lower section, while the upper section (evaporator of the circuit of air conditioning) is dried and the refrigerant boils at the lower temperature and pressure only in the lower, low temperature section until it boils out completely or until the compressor is switched off by a pressure relay. The drop of pressure below the given value results in reduction of boiling temperature which as a result corresponds to temperature reduction in the whole low temperature section to a given level. For example, boiling of halon R-22 at the atmospheric pressure corresponds to the temperature of −40° C., and with unrecuperation of 5° C. at temperature in the evaporator is −35° C. This temperature is sufficient for full fast cooling of objects in the low temperature chamber and for accumulation of cold quantity required for covering the demands during the period of stationary mode of operation of the conditioning section with the low temperature evaporator switched off.

Production of cooling at the temperature level which is substantially lower than the temperature level generated in a known one stage compression cycle can be also obtained in a modified cycle which provides periodic circulation of a portion of a total flow of refrigerant under pressure, with substantially lower suction pressure of the main compressor which is reduced by ejecting this auxiliary flow by the main flow of vapor phase of refrigerant in the high temperature part of the cycle.

The realization of this refrigerant flow of low pressure providing cold production at the lowest temperature level can be performed periodically, during accumulation of reserves of high temperature cold and refrigerant mass in the main circuit of the cycle generating cold of high temperature. This accumulation is advantageous in the process of partial evaporation of refrigerant in the main circuit of the cycle during transfer of cold to a consumer of high level cold. The liquid phase of the refrigerant which is sorted out can be efficiently ejected by the main flow of refrigerant vapors after accumulation of the necessary portion of refrigerant, so as to provide cyclic production of corresponding portions of low level cold.

The regulation of accumulation speed of the refrigerant portion required for producing a portion of cold with level, is performed by changing the ratio of power for generation of a flow of liquid refrigerant (in other words cooling efficiency of the main cycle) and the power of heat emission of cold consumers at this level. The speed of accumulation of excessive liquid refrigerant is directly proportional to the difference of these values. Regulation of each of these values is performed by changing the duration of time of switching on and rotation frequency of the compressor, cooling intensity of the condenser and heat supply to the evaporator, the value of hydraulic resistance of throttling valve, etc. In practice the simplest and most efficient method is the method of changing the intensity of heat supply from the object to be cooled.

For transition from the first stage of cold generation to the second low temperature stage, it is necessary to supply adequate information about the reduction of temperature level of the object to be cooled at the first stage or the consumption of refrigerant. With the external temperature control the presence of the additional low temperature second stage does not have influence to the efficiency of operation of the main first stage. When these conditions are fulfilled, automatic switching of modes of operation of the system is performed. The switching of the modes can be accelerated when the object to be cooled is introduced at the second stage under the condition that this object blocks in the first stage the heat supply to the refrigerant to be evaporated. This is equivalent to reduction of demand in cold at the first stage resulting in accumulation of refrigerant supply and temperature reduction in the special points and zones of the first stage and subsequent automatic switching of the modes and stages of cooling.

Since the cold at the first and second stages is generated alternatingly and each stage has its own cold consumption, it is advantageous to accumulate cold at each temperature level for covering demands during the period of cold generation at another level (in other words when the other cooling stage is operational). For accumulating the cold, the system can include components which are frozen (solidified) at their temperature levels. Cold at the lower temperature level can be accumulated by an auxiliary heat carrier which is frozen in containers contacting with evaporating refrigerant.

For accumulating cold at the higher temperature level (in the first stage) mass of metals connected to the evaporator and frozen liquids are utilized as well as ice and frost frozen out on the surfaces are used. For accumulating cold at this level it is also possible to use atmospheric air confined in an enclosed space, especially in the systems of air conditioning.

Cooling of condensor can be improved and the compression degree can be correspondingly reduced by the use during operation of the installation in the freezing mode at the second stage of cold accumulated by a partial take up of cooling efficiency during the previous period of installation operation (in the mode of production of high potential cold, or in other words in the mode of air conditioning). In this situation the refrigerating medium can be air which is cooled in a dwelling. When the installation is switched from the conditioning mode to the freezing mode with a freezer, special closures switch the sir flow directed to condenser from the external air receiver to the internal air receiver from the space with air conditioning.

In the second variant an additional intermediate heat carrier, for example partially frozen water, ethylene glycol, etc., is used. The additional heat carrier fills the auxiliary heat exchanging circuit connected the high temperature section of the evaporator-cooler and the condenser of the installation. These apparatuses are provided with additional heat exchanging sections for heat exchange with the auxiliary circuit.

During the operation of the system in the mode of conditioning, the condenser is cooled by exterior atmospheric air and the temperature of condensation reaches +40°–+50° C. During this period the additional heat carrier is cooled in an intermediate circuit to −1°–5° C. and partially froze out. At the next stage during operation in the mode of freezing out, the condenser is cooled by the additional heat carrier which accumulated cold at the level 0°–+10° C. and correspondingly the condensation temperature is +3°–+15° C. so that the compression degree can be reduced with other equal conditions 1.5–2 times. Lowest temperatures are obtained in the mode of freezing with the same compressor-condenser aggregate. The system equipment successively operates in the modes of upper and lower temperature cycles of the cascade cooling device, so that the same low temperatures can be obtained with half the quantity of the used equipment and with cold supply at two levels for different consumers with simultaneous accumulation of cold and its subsequent use when needed.

Reduction of temperature and condensation pressure leads to the reduction of compression degree of the compressor or with the same compression degree leads to corresponding reduction of temperature level of cooling at the second stage. For example, with the temperature of cooling medium (melting ice) 0° C., temperature drop during condensation of 3° C. standard compression degree and temperature drop in the evaporation 3° C., with the use of standard halon R 22 the cooling temperature at the second stage is −40° C. Cold which usually lost irreversibly for freezing out of water vapors is returned at the lower temperature level of the second stage and therefore utilized with simultaneously defrosting the evaporator of the first stage.

Growth of layer thickness of frost above a certain value which is determined by parameters of frost and the whole system leads to the reduction of system efficiency, diminishing of cooling efficiency and decrease of refrigerant temperature. It is therefore advisable during the operation of the first cooling stage for generation of high temperature cold to change the frost parameters (with evaluation of its thermal resistance) and to go to the mode of the second stage of cooling when the parameters of frost reach a predetermined limiting value with consideration of this moment as an end of the mode (in other words by comparing of the effect of worsening of parameters of heat transfer from evaporators due to frost generation with the effect of reaching a given level of cooling of objects of the first stage with subsequent changes of modes and cooling stages).

Cold transfer from evaporating refrigerant to the object can be performed both through the additional heat transferring medium for example atmospheric air which fills the cooling chamber, and also by a direct contact heat exchange between the elements of the evaporating device and the object. For providing high efficiency of heat transfer by contact method it is advisable to provide a maximum tight contact of extensive heat exchange surface of the adjoining elements. Good thermal conductivity of the contact zone can be provided by shaped forms of the adjoining surfaces with the projections of one surface engaging in depressions of another surface. The simplest and easiest for manufacture surface can be provided in the shape of comb-like projections and corresponding triangular depressions with an apex angle of 15°–60° to produce high specific surface of heat contact per base surface unit as well as a sufficient pressure of contact compression.

Thermal resistance of contact can be also reduced, and dismounting of the adjoining surfaces in cold state can be facilitated by applying a thin-film adhesive coating on the contacting surfaces, formed for example of polymeric material with heat conductive fillers. Water vapors frozen out from air on such contacting surface during its use, of the anti-adhesive properties of the materials which are utilized only insignificantly complicates dismounting of such a joint in cold state.

Heat transfer from objects of standard shapes and sizes which preferably have the shape of body of revolution with a smooth surface can be performed through a springy heat exchange elements which have high heat conductivity (for example springs), connected with the formation of efficient heat transferring heat contacts with the cooling surface of cold sources and pressed to points of surface of the object to be cooled or heated.

Highly efficient intense heat exchange to the evaporating cooling refrigerant can be performed by turning of refrigerant flow during its thin-layer flowing. Such flowing can be provided for example between the bodies of revolution arranged with a gap with the adjoining surfaces having a saw-tooth shape, when the projections of the profile of one of the elements engage in the gaps of the profile of the other element.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings. dr

BRIEF DESCRIPTION OF THE DRAWINGS

FIGS. 10 and 11 are views showing a cooling device with the use of air which is preliminarily cooled during the operation of a first stage, for cooling of a condenser;

DESCRIPTION OF THE PREFERRED EMBODIMENTS

Figure 1:
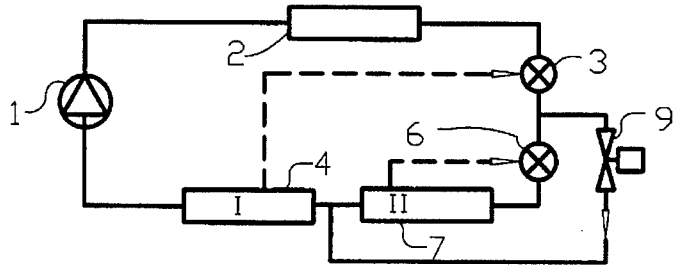
FIGS. 1 and 2 are views showing a cooling device for alternative cold production at two and more temperature levels, in two variants.
Figure 2:
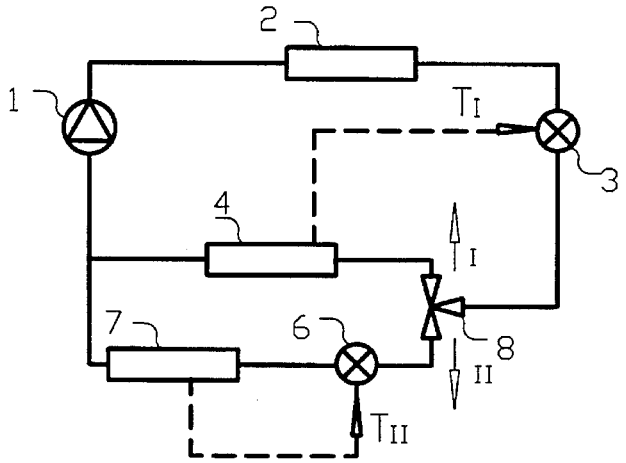

A cooling device in accordance with the present invention is shown in FIGS. 1, 2 and includes a compressor 1 for compressing vapors of a refrigerant, a condenser 2 which cools and condenses the refrigerant vapors with an atmospheric air flow or water, a throttle of a first stage 3, an evaporator of the first stage 4, a throttle section 6 of a second stage, an evaporator 7 of the second stage, a switching valve 8.

During the operation in accordance with FIG. 2 for producing cold at an upper temperature level, refrigerant at the first stage which is liquefied in the condenser 2 and throttled by the regulating valve or the capillary pipe 3 is supplied by the switching valve 8 into the high temperature evaporator 4 of the first stage, it is evaporated and its vapors are inhausted by the compressor 1. For producing a low temperature cold at the second stage, the switching valve 8 is switched to the second position and supplies the refrigerant into the additional throttling section 6 of the second stage, from which with the reduction of pressure the agent is supplied to the evaporator 7 of the second stage and then also to the suction of, the compressor 1. The hydraulic resistance of two successively connected throttling sections (during the operation of the second stage), exceeds the resistance of one section 3 (during the operation of the first stage), and refrigerant supply into the evaporator 7 is lower than into the evaporator 4. With the equal volume efficiency of the compressor 1, at the second stage lower pressure is established and therefore the temperature of refrigerant boiling in the evaporator 7 is reduced when compared with the evaporator 4 (first stage). The same result is obtained with the use of the device of FIG. 1. Here both evaporators 4 and 7 are permanently connected with a recirculating circuit, and the two-section throttle (3, 6) is replaced with a switchable two-position thermo-regulating valve 3 which hydraulically is analogous to the above described pair with the switching-off section. The switching valves in this circuit are eliminated. The regulating valve performs two-position regulation of hydraulic resistance of the line and refrigerant consumption. Two positions of the throttle correspond to two fixed values of hydraulic resistance of coefficient of the throttling device. In the simplified variant of the device both evaporators are cooled at all modes of operation. However, during the operation of the first stage the temperature of the first evaporator of the second stage as considered in direction of the flow is insufficiently low for cooling the object of the second stage to a given low level. Therefore almost all cold in this mode is transferred to the evaporator 4 and then to the object of the first stage (in the conditioning device air is cooled). To the contrary, when the throttle 3 is switched to the position with the higher value of hydraulic resistance or the regulating valve is switched to the low temperature, the boiling temperature of refrigerant is reduced to the level of the second state and the object connected with the evaporator 7 is cooled. However, since in this mode the mass flow of refrigerant is reduced, greater part of cold is transferred by the boiling refrigerant in the first evaporator 7 after the throttle in direction of flow while the evaporator 4 performs only a small overheating of the refrigerant vapors with insignificant cooling efficiency of this process. Similar effect of reduction of pressure in boiling temperature of refrigerant is obtained with increased volume efficiency of compressor due to increase of pressure jump at the throttle with the same value of hydraulic resistance coefficient and increased flow speed.

Figure 3:
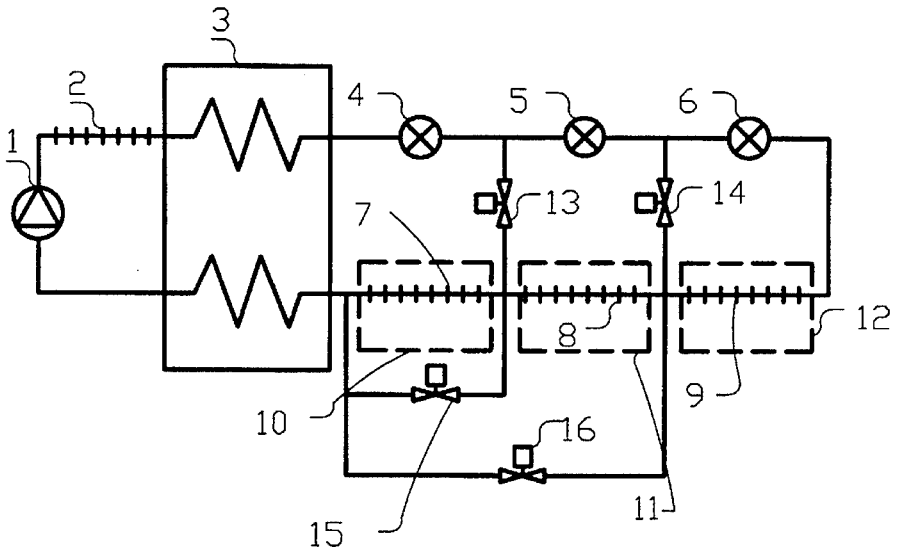
FIG. 3 is a view illustrating a device with an increased number of temperature levels.

Three level cooling device shown in FIG. 3 is provided for producing cold at three temperature levels. It has a one stage compressor 1, a condenser of compressed refrigerant vapors 2, a recuperator-supercooler of the compressed refrigerant 3, throttle valves formed as local or distributed hydraulic resistances 4, 5, and 6, cooling chambers or other cold consumers 10, 11 and 12, refrigerant evaporators 7, 8, and 9 arranged in them, control driven valves 13, 14, 15, and 16. Therefore the throttling device of the compression cooling device is formed as section 4, 5 and 6 connected in series, and the same number of evaporators 7, 8 and 9 connected in series and connectable into the common circuit of apparatuses connected in series or disconnected from it by bypass lines with closing valves 15 and 16 in them. The sections of the throttling device can be formed as calibrated local hydraulic resistances, distributed hydraulic resistances, regulating valves, sections of capillary pipes, and adjustable throttling valves. When all three sections of the throttling device (valves of bypasses 13 and 14 are closed) are included in the circulating circuit of the cooling device, the refrigerant flow through the compressor and suction pressure of the compressor and also the corresponding pressure and temperature of refrigerant boiling are established at minimal levels. In this case the object which loads the evaporator 9 is cooled, or in other words the chamber 12. In this case the valve 16 can be opened and the refrigerant vapors are supplied after the evaporator 9 through the heat exchanger 3 to the suction of the compressor 1. However, since in practice in many cases the hydraulic resistance of the evaporator 7 and 8 is low and does not substantially influence the operation of the device, it is possible to make the cooling device only with two closure valves 13 and 14. In the two-level variant of the device there is one bypass with the closure valve 13 or 15, two throttles and also two sections of the evaporators and the cooling chamber. The table presented hereinbelow shows the position of the closure valves 13–16, providing three main modes of a single stage multi-purpose device wherein plus is the position of the open valve and minus is the position of the closed valve.

| | VALVE POSITIONS | | | |
|---|---|---|---|---|
| Mode Number | 13 | 14 | 15 | 16 |
| I. $T_0 = +5°$ C.: $Q_0 = 6$ kwt | + | − | − | − |
| II. $T_0 = -7°$ C.; $Q_0 = 5$ kwt | − | + | + | − |
| III. $T_0 = -30°$ C.; $Q_0 = 0.5$ kwt | − | − | − | + |

The regulating throttling device can also be formed by parallel sections or single driven adjustable valves which can be regulated smoothly manually or automatically.

Figure 4:
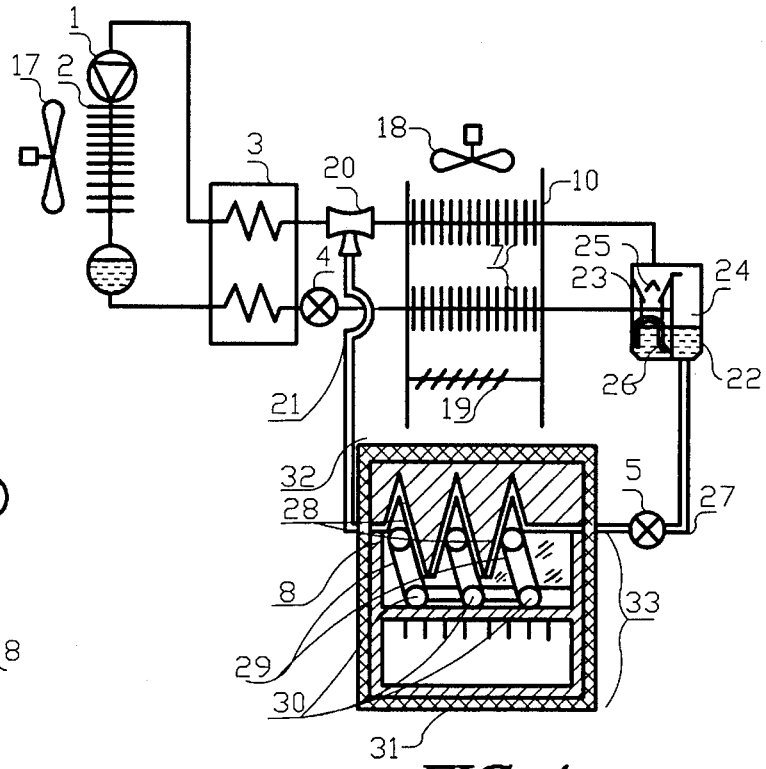
FIG. 4 is a view showing a modification of a car conditioner with ejector in the second stage and split refrigeration chamber.

Another way of regulating the pressure of boiling and temperature of refrigerant in the evaporator includes the use an ejector stage introduced into the main circulating circuit of the device as shown in FIG. 4. A through flow part of the ejector 20 is connected in series to one point of the circulating circuit. In most cases it is preferable to introduce the ejector at the point of circulation of overheated vapor of the refrigerant between the evaporator of the upper temperature level 7 and a coil of the recuperator-supercooler 3 (20). Withdrawal of liquid phase of the low temperature injector circuit is advisable to provide from the liquid part of the circuit after the throttle 4.

For reaching the objective of producing cold of low temperature level without any adverse effect for the cooling efficiency of the high temperature section of the device it is necessary to provide a separator of the liquid refrigerant 22 between the sections of the high temperature evaporator 7. Therefore a part of surface of the high temperature evaporator precedes in the direction of refrigerant flow, the refrigerant separator, and another part of the surface is arranged after the separator. A throttle valve 5 is located in the line of withdrawal of liquid refrigerator 7 from the separator 22. The separator 22 is subdivided into two communicating vessels 23 and 24 whose vapor spaces are directly connected with one another. In the liquid part of the vessel 23 which is first in direction of flow of refrigerator, a hydraulic syphon 26 is provided and connects liquid, lower parts of the vessels 23 and 24. The position of the upper leg of the syphon 26 determines the filling level of the vessel 23, after which fast emptying of the vessel 23 is provided with overflow to the vessel 24. The full overflow of the full accumulated portion of the liquid refrigerant is possible when the vessel 24 is located below the vessel 23. A droplet withdrawal device 25 is located in the upper part of the vessel 23. The evaporator 7 is arranged in an air guiding chamber 10 provided with the fan for ventilation of the heat exchanging surfaces of the evaporator 7 and an air-flap 19 regulates the air speed.

When the low temperature section of the device is switched off (by a not shown closure valve in the line 27), the high temperature circuit operates as a conventional one-stage compression cooling device. When the low temperature circuit is switched on the ejector 20 produces a rarification in the suction pipe 21. The input of the low temperature evaporator 8 is connected to the line of refrigerant supply 27 through the throttle 5, while its output is connected to the suction pipe 21 of the ejector 20. In this circuit the pressure is established at the level which is substantially lower than the suction pressure of the compressor 1. Therefore the boiling temperature of the refrigerant in the evaporator 8 is substantially lower than the temperature in the evaporator 7. In the initial period after starting of the device with the vessel 24 empty, a vapor phase of the refrigerant circulates in the low temperature circuit through the evaporator 8. The liquid phase of the refrigerant is evaporated in the first section of the evaporator 7 as considered in direction of refrigerant flow, so as to cool air supplied by the fan 18. The flow rate and speed of air is regulated by the closure 19 or by the change in the rotation frequency or front angle of the vanes of the fan 18. With the intensive supply of heat from air to the first section of the evaporator 7, the refrigerant is completely evaporated in this section. The reduction of this load is obtained either naturally during a gradual reduction of the air temperature, or by a regulating action, by reduction of rotary speed or stoppage of the fan or reduction of speed of ventilation by closing the closure 19. When there is an excessive quantity of the liquid phase, the refrigerant starts accumulating in the vessel 23 of the separator 22. After filling of the syphon 26, the refrigerant is drained into the vessel 24, from which it is supplied to evaporator 8 and evaporated at the low suction pressure of the ejector 20 so as to cool the low temperature chamber 33. If the suction speed of refrigerant by the ejector exceeds the speed of refrigerant supply and accumulation of liquid in the separator, then after emptying of the vessel 24 the generation of the low temperature cold in the evaporator 8 is stopped until the next portion of liquid is accumulated in the separator. Therefore, in the low temperature ejector-compressor circuit, an excessive cooling efficiency relative "warm" single-stage compression cycle is provided. The excessive cooling efficiency is transformed into the lower level of temperatures corresponding to the requirements of objects to be cooled by this circuit. Switching on and switching off of the ejector circuit is performed automatically. The main physical parameter which controls the operation of the circuit (with open valves in the line 27) is a liquid level in the supply circuit of the vessel 24 of the separator 22. This level is a complicated resulting function of a set of physical processes, which provides cold generation by the cooling device and heat supply from objects to be cooled. This quantity of liquid refrigerant accumulated by a separator 22 which can be supplied for production of the low temperature into the ejector circuit, is directly proportional to the integrated excessive cooling efficiency of the main compression cooling cycle.

It is also possible to connect the line of withdrawal of the refrigerant 27 to the vessel 22 without the syphon 26 and vessel 24. In this case, it is more difficult to provide stable modes of use of the ejector stage due to substantial fluctuations of flow rates, and passages of vapor-liquid mixture through the line 27.

When it is necessary to provide a priority cooling of the low temperature object by the lower ejector stage, automatic or manual reduction of the cold withdrawal at the upper temperature level from the evaporator 7 is provided. For example, when a low temperature cooling chamber 33 is connected to the evaporator 8, it closes partially or completely (in dependence on the required cooling efficiency of the ejector control) by the closure 19 a flow of heating air which supplies heat to the evaporator 7. The pusher 32 can also act on the sensor elements of electrical or electronic control circuit which regulates the rotation frequency and speed of air supply by the fan 18, the supply of refrigerant by the compressor 1, and also the main working parameters of the ejector when the regulating ejectors are utilized. A simple cut off of the air supply of the fan 18 by the housing of the removable chamber 33 provides a regulating action which is analogous to the action of the closure 19.

Figure 5A:
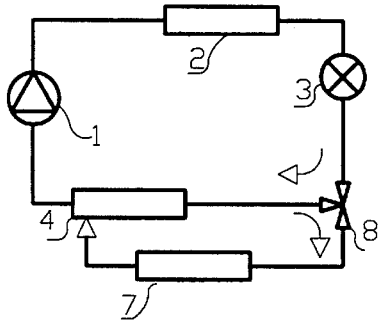
FIGS. 5*a, b, c* show a cooling device with a use in a low temperature evaporator of the remaining portion of refrigerant from an evaporator of a first stage.

Cooling devices are shown in FIGS. 5*a, b, c* interrupt the supply of the refrigerant from compressor after the temperature of objects cooled at the first stage is achieved. Rest of the liquid refrigerant overflows from the evaporator 4 into the evaporator 7 of the second stage while the continuing pumping out of refrigerant vapors by the compressor from the low temperature circuit.

Positions of the switching valve 8 determine modes of the cooling device. On the first stage the valve 8 connects the outlets from the condenser 2 with the inlet of the evaporator 4, forming the circuit of the compressing-vapor refrigerator. After switching the valve 8 closes the line between the throttle 3 and evaporator 4 evaporator 7. The rest of the refrigerant from the evaporator 4 overflows into the evaporator 7. The cooling device shown in FIG. 5*a* returns vapors into the suction of the compressor through the evaporator 7, which is utilized as a separator of the liquid refrigerant. The device shown in FIG. 5*c* has a closing valve 10 between the output of the evaporator 4 and the suction of the compressor 1. During of the mode of the low temperature cold generation the valve 10 is closed and the rest of the refrigerant overflows into the evaporator 7 independently of its location, even if the evaporator 7 is in the upper position.

Figure 5B:
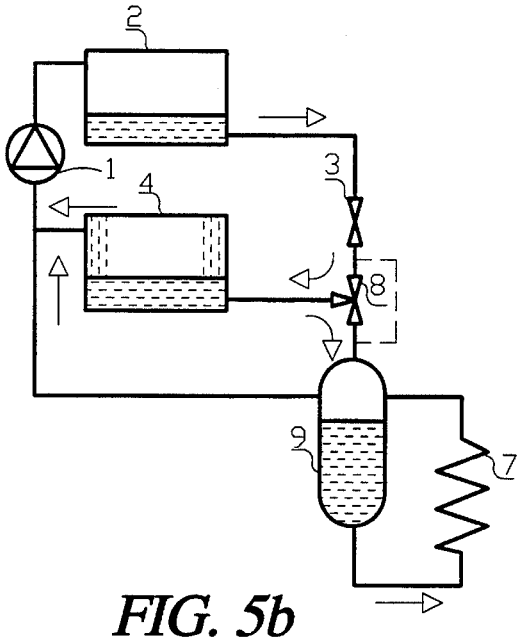
Figure 5C:
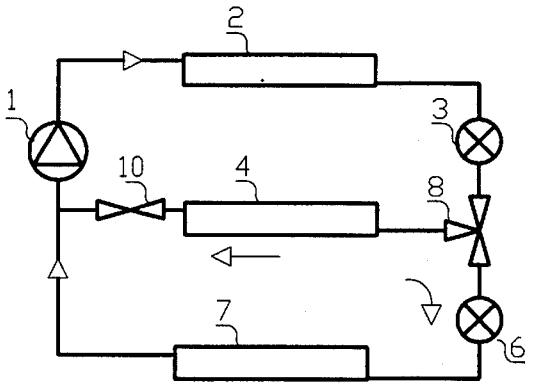

The device is shown in FIG. 5*b* has a vessel 9 which is a special separator of liquid refrigerant.

Figure 6A:
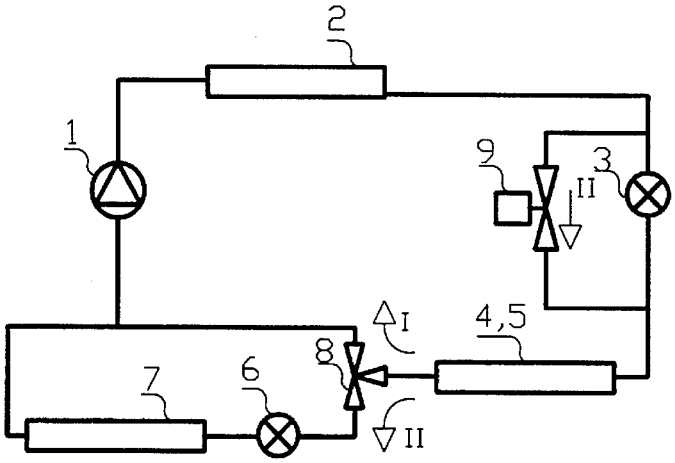
FIGS. 6, 7, 8, 9–13 show cooling devices which provide utilization of cold accumulated during the operation at a first stage of cold production.

Cooling devices shown in FIGS. 6*a, b*, 8, 9, 10–13 use for condensation of refrigerant vapors during the operation of the second stage, cold which is accumulated during operation of the first stage. A simple, base device of this group shown in FIGS. 6*a, b* includes conventional standard components with a compressor 1, a condenser 2, cooled by atmospheric air or water, a throttle 3, and evaporator 4, contains a switching valve 8 with an input connected to an output of the evaporator 4, one output connected directly with the suction side of the compressor 1, and another output connected in series with an additional section of the throttle 6 and low temperature evaporator 7 whose outlet is connected with the suction of the compressor 1. The throttle 3 is shunted by an electromagnetic closure valve 9. During the operation in accordance with the first stage, the switching valve 8 directly connects the output of the evaporator 4 with the suction of the compressor 1. The valve 9 is closed. In this position, the circuit does not differ from the classic one-stage cooling device. During the operation in this mode ice and frost are frozen on the evaporator 4 and they are good cold accumulators. With the sufficient cooling of the object of the first stage (for example air in the chamber) the circuit is switched to the second stage of generation of low temperature cold.

Figure 6B:
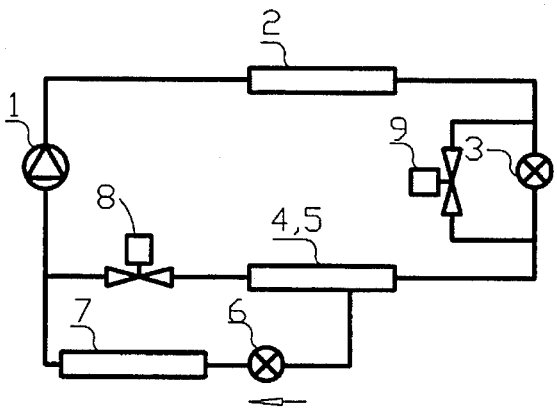

A modified circuit shown in FIG. 6*b* differs from the circuit of FIG. 6*a* by the point of withdrawal of liquid, from the intermediate sections of the heat exchanger 4.

Figure 7:
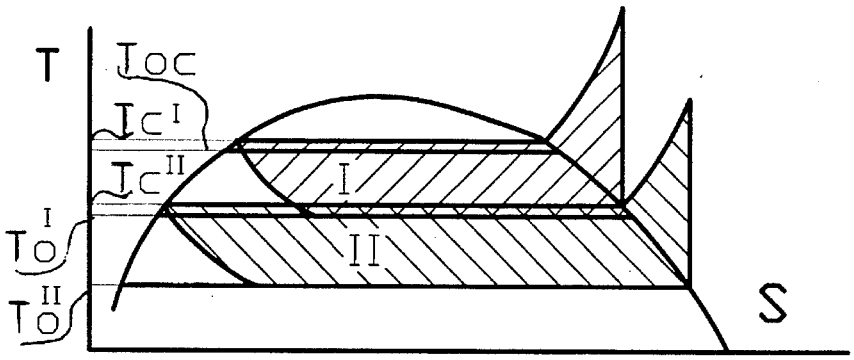

The switching valve 8 connects the outlet from the evaporator 4 with the throttle 6 of the second stage, the outlet of the throttle 6 with the inlet of the evaporator 7 of the second stage, the outlet from the evaporator 7 with the suction of the compressor 1. The valve 9 is open and the flow of refrigerant is supplied bypassing the throttle 3 which is switched off (the pressure differential at it becomes equal to zero) with the open bypass switched on by the valve 9. In the transformed circulating, circuit again one-stage cooling vapor-compression cycle is provided. The distinction of this cycle is the provision of the two-mode condenser-vaporizer. The first mode of the condenser-vaporizer a condenser of the second stage and the second mode of the condenser-vaporizer is an evaporator 4 of the first stage. The evaporator of the first stage is in the circuit for the throttle 6 and operates under the pumping pressure to cool the condensing refrigerant vapors due to the use of cold accumulated at the preceding mode. Since functions and operational conditions of this device change in principle with the change of the mode of operation the term "condenser" is applicable for the second stage as identified with 4–5. The substantial difference in the parameters of the modes of the first and second stages of cooling is the difference in temperatures of condensation of refrigerant in tenth of degrees. At the first stage the condensation temperatures are 305K–325K, while in the second stage when water ice is used as a cold accumulating medium the temperatures of condensation are 275K–280K. The diagram T-S (temperature-entropy) shown in FIG. 7 illustrates thermo-dynamic characteristic of interconnected cooling cycles of the first and second stages. The diagram clearly shows that the system provides alternatingly the modes of two-cascade cooling cycle. Here, the advantages of the two-compressor cascade cycle (low temperature of refrigerant evaporation in the second stage) are combined with the advantages of a simple one-stage cycle (simplicity, reliability, low weight, cost, size of one-compressor cooling device).

The system shown in FIG. 6 is used for producing relatively small quantities of cold at the low temperature level of the second stage. For example, the system of air conditioning of automobile has the cooling efficiency 10–20 BTU, while the power of freezing device of the modified system based on the conditioner during the production of cold at the second stage provides cooling efficiency of the second stage which is equal to 15–30% of the cooling efficiency of the first stage with the above mentioned parameters. Therefore, the excessive peak cooling efficiency at the second stage accumulates also with the aid of heat which freeze at the level of the working temperatures of the second stage. The realization of the cycle in the above mentioned temperature interval (FIG. 7) continues until the stored cold accumulated at the first stage is used for condensing in the second stage. When this stored cold is depleted, the condensation temperature of the second stage is increased to the conventional level of the ambient temperature, and with the reduction of cooling efficiency of the second stage, the boiling temperature of the refrigerant is increased.

Thermo-dynamic cycles which are analogous to the above presented cycle of the base device are realized in modifications of the basic device shown in FIGS. 8, 9, 10, 11, 12, 13. The structural differences are connected mainly with the specifics of accumulation and use of accumulated cold for condensation at the second stage.

Figure 8:
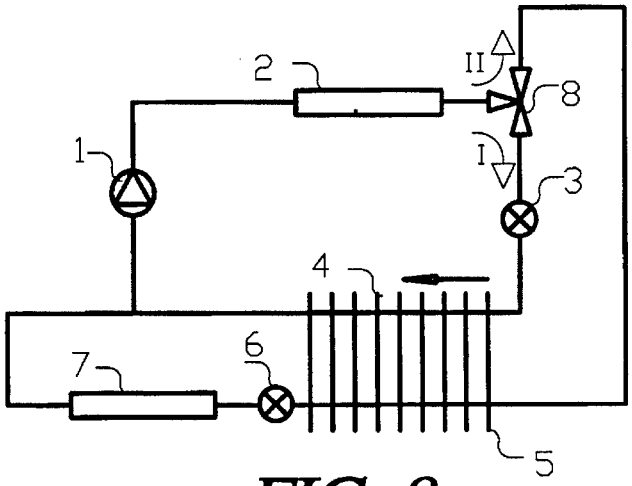
Figure 9:
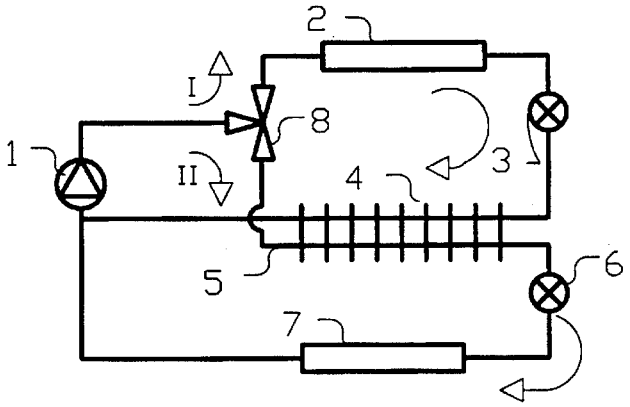

In the device shown in FIGS. 8 and 9 the evaporators 4 of the first stage and the condenser 5 of the second stage have their own passages which however are connected by hydraulically passive heat transmitting elements, for example joint heat exchanging ribs and panels. This allows to simplify the switching modes and to design the elements of the circuits of the first and second stages which more completely correspond to the peculiarities of the cycles. In the device of FIG. 9 the heat exchanger of the condenser 2 of the first stage is switched off at the second stage, and in FIG. 8 is used for the preliminary cooling of the refrigerant vapors.

Figure 10:
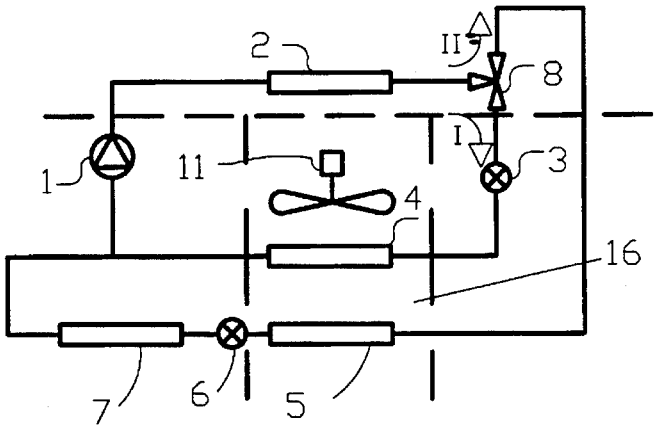
Figure 11:
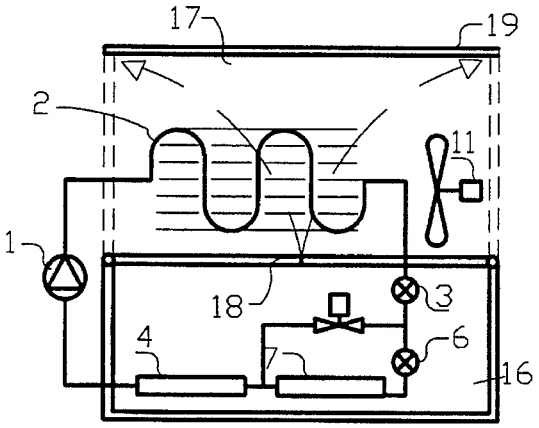

In the devices of FIGS. 10 and 11 the first main stage is provided for the air conditioning and cold accumulated by air cooled in the zone of operation of the device is utilized.

Since such devices at the second stage are used in a short-time pulse mode, for a very little time (2–5% of time of operation in conditioning mode) the quantity of condensation heat introduced into the system of the first stage in this variant only insignificantly influences the total regime of operation and can be easily compensated by increase in the duration of time or generation of cold at the level of the first stage (air conditioning) for a corresponding time. This difference is very small since the generated low temperature cold is most frequently used for cooling the internal space of active operation of air conditioning systems; and through the thermal insulation of low size devices for freezing (consumers of cold in the second stage) the cold is returned with low losses to the consumer of cold of the first stage.

The two-loop circuit of the device of FIG. 10 is equivalent to the above described device of FIG. 8 with the only difference that the heat exchange between the condenser of the second stage and the evaporator of the first stage is provided by an air flow supplied by the fan 11. Cold is accumulated in this device both by air and freezing out frost. It is also possible to use additional heat carriers confined in additional vessels which are in contact with the evaporator 4. During the operation of the device shown in FIG. 11 in the mode of air conditioning, the evaporator 4 of the loop 1 is located inside the cooling chamber 16, while the condenser 2 is located inside an air passage 17 formed by a screen 19 and folded flaps 18 of the front wall of the chamber 16. The cooling air is pumped from atmosphere into the passage 17 by the fan 11. During switching to the second stage of generation of low temperature cold, the flaps 18 are unfolded until they touch the screen 19. The volume of the chamber 16 is increased, and it includes now the condenser 2 and the fan 11 which ventilates the condenser with the preliminarily cooled air from the chamber 16. This additionally reduces the temperature of condensation and evaporation of refrigerant in the evaporator 7 of the second stage by 10°–15°.

Figure 12:
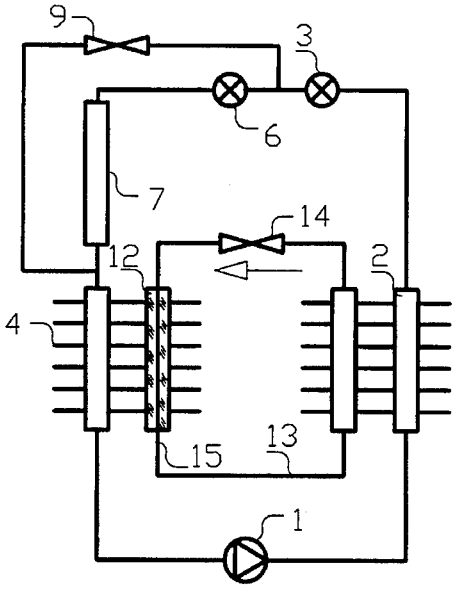

The device of FIG. 12 has a special circulating circuit 13 for accumulating of cold of the first stage. The cold accumulator 12 is filled with a material to be frozen and is in a heat contact with the evaporator 4 of the first stage and the condenser 15 of the thermal syphon 13. The condenser 2 of the first stage is in a heat contact with the evaporator of the thermal syphon 13 which is filled with a low boiling additional heat carrier. During the operation of the first stage cold is partially accumulated by the heat carrier which is frozen in the cold accumulator 12. The additional section of the throttle 6 and the evaporator 7 are switched off with the closed valve 9 of the bypass line. During switching to the second stage the valve 9 of the bypass is closed and the valve 14 of the thermo-syphon 13 is opened The heat carrier circulating in the thermo-syphon 13 transfers cold from the cold accumulator 12 to the condenser 2 of the cooling device.

Figure 13:
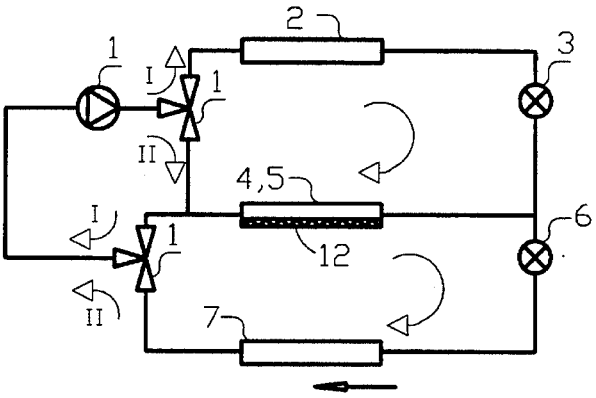

In the cooling device shown in FIG. 13 the cold accumulator is in a constant heat contact with the heat exchanger 4. The compressor is connected with the lines of the loops by switching valves 8, 9. One of the outlets of the switching valves 8 in the pumping line is connected with the inlet of the condenser of the first stage, while another outlet is connected with the line connecting the outlet of the condenser 4 of the first stage (which during the switching off performs the functions of the condenser 5 of the second stage) with one of the inlets of the other switching valve 9 in the suction line. The second inlet of the above mentioned switching valve 9 is connected with the evaporator 7 of the second stage. The inlet of the evaporator of the second stage is connected by a line including a throttle 6 of the second stage, with the inlet of the evaporator 4–5 of the first stage. During supply of the compressed refrigerant into the loop of the first stage (condenser 2, throttle 3, evaporator 4–5) cold is accumulated by the material frozen in the accumulator 12 and freezing out on the surfaces of heat exchanger of evaporator 4 as moisture. During switching of the flow to the loop of the second stage, hot vapors of the refrigerant are supplied from the compressor 1 into the heat exchanger 4–5. In the second stage it performs the functions of the condenser 5. During this period cold stored in the cold accumulator 12 and snow coating on the surface of the heat exchanger 4–5 is spent for condensation of the refrigerant at the lowered temperature and pressure.

Figure 14A:
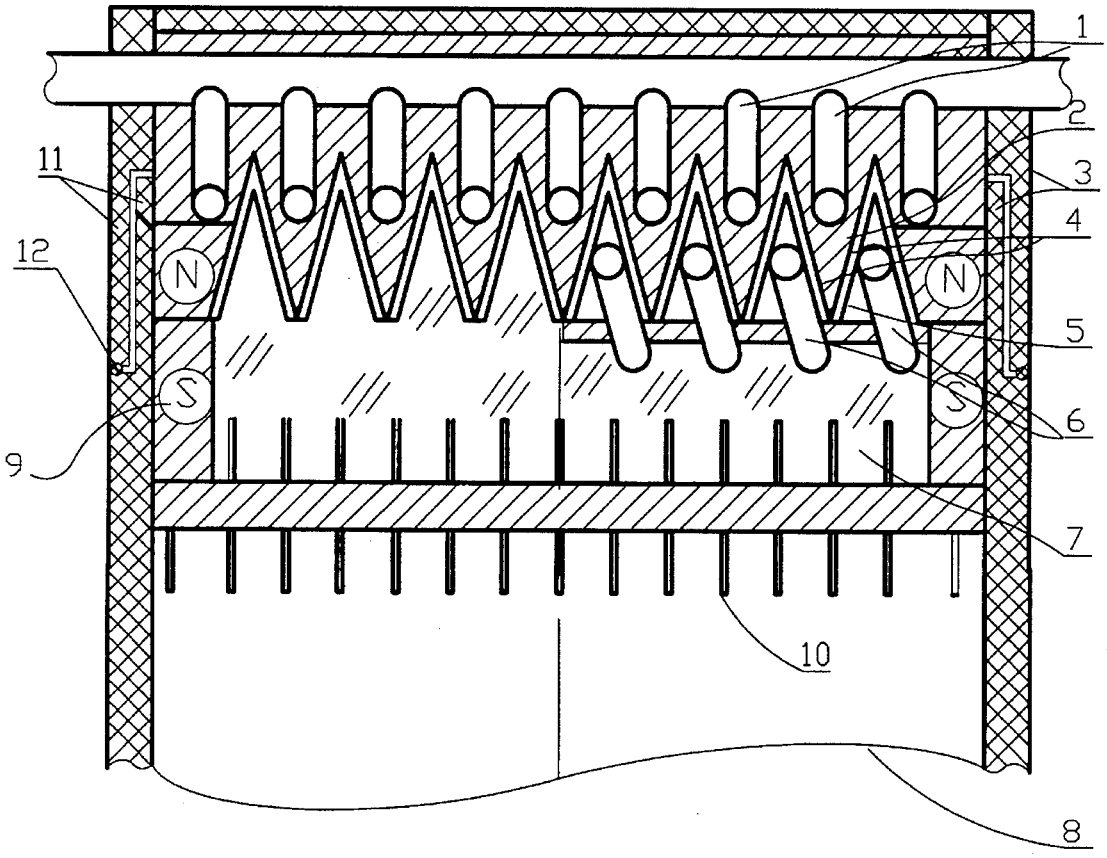
FIGS. 14*a* and 14*b* is a view showing a composite split autonomous cooling chamber.

FIGS. 14*a, b* shoes a split cooling chamber which provides simple and fast mechanical connection of the low temperature cold consumer to the cold generator. The chamber includes two main blocks. The upper block is an adaptor which is stationarily mounted in the main part of the circuit of the cooling device. Coils 1 are evaporators of the refrigerant which generates cold in them. The coils 1 are located in a metal cast housing of the evaporator 2, and its lower surface has a saw-tooth profile which forms a thermal contact surface 4. The apex angle of the triangular section of the profile is 30° and the height of the profile peaks is 10 mm. The coefficient of ribbing with the shape of the base surface is approximately 4. Correspondingly the working chamber 8 is used for accommodating of objects to be cooled and thermostated at the working level of temperatures. Its upper part also has a shape corresponding to the shape of the evaporator housing 2. The projections of the shape of one part are exactly engaged in the depressions of the opposite part so as to provide a tight mechanical contact of the heat transmitting surfaces 4. An anti-adhesive layer 5 applied on the surfaces 4 increases the tightness of the contact so as to provide high thermal conductivity of the contact zone.

The layer can be formed for example from tetrafluorethylene with a micro-grain filler such as aluminum powder. The layer thickness is 40–150 micrometers. During freezing of small quantities of water in use the coating 5 which has anti-adhesive properties facilitates the dismounting of the chamber and separation of the surfaces 4. A cold accumulator 7 is located between the working volume of the chamber 8 and its contact contour 4. It is a space which is filled with an additional heat carrier which is subjected to phase transformations during cooling at the working level of temperatures. For example, at the temperature of refrigerant boiling in the evaporator 1 equal to −45° C. halon R 113 can be utilized which has the freezing temperature −36.6° C. When 5–10% of halon R 12 which is subjected to conversion liquid-vapor within the mentioned temperature interval is added to the mixture, the circulation of the heat carrier in the cold accumulator is improved so as to improve its heat transferring characteristics. The second variant of the use of the cold accumulator (right side of FIG. 14) includes the use of the heat transfer from the cold accumulating heat carrier to the surface 4 of "thermo-diodes"–"thermo-syphon" 6 filled with an intermediate low boiling heat carrier having the property of single-directional heat transfer from the chamber 8 outside through the contact surfaces 4 to the outside cooling source. Their use reduces cold losses to the ambient area and freezing of the surfaces 4 during autonomous use of the chamber 8 disconnected during this period from the evaporator 1.

Magnets 9 are located along the perimeter of the adjoining heat exchanging surfaces 4 and they perform the function of pulling together the upper block mounted in the cooling device and the autonomous removable lower block-chamber during cold accumulation. The magnets on the adjoining parts are arranged with low gaps 0.1–0.3 mm between the different sign poles of the adjoining magnets to provide sufficient compression forces for the blocks. Since the projections of the triangular profile having low angles at the apexes due to the wedging effect increase the stresses which compress the contacting surfaces many times, the system of pulling the blocks together provides for high thermal conductivity.

Ribbing 10 of the surfaces of the working chamber 8 intensifies the heat exchange between the heat carrier of the cold accumulator 7 and the working volume of the chamber 8. The thermal insulation layer 3 which covers the blocks of the cooling chamber prevent cold losses.

Additional, not shown heat insulating covers prevent cold losses and moisture freezing out from air on the contacting heat transferring surfaces 4 during autonomous use of the dismountable cooling chamber. A moisture impermeable seal 12 is located in the plane of separation of the blocks for example in the zone of joint of elements of the heat insulation 11 and perform the same functions.

Figure 15A:
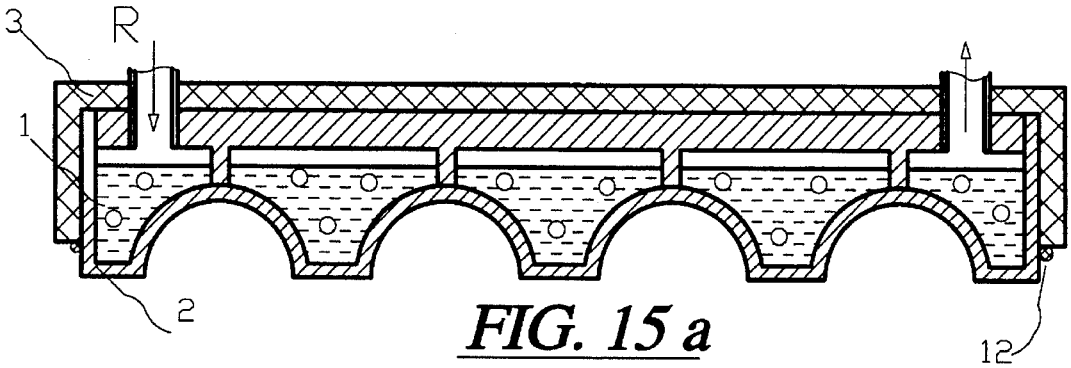
FIGS. 15*a, b, c, d, e, f* are views showing modifications of contact surfaces.
Figure 15B:
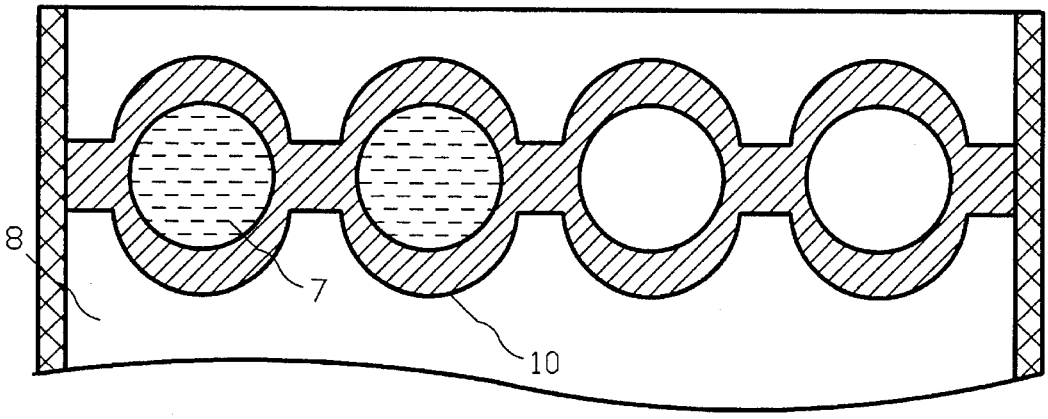
Figure 15C:
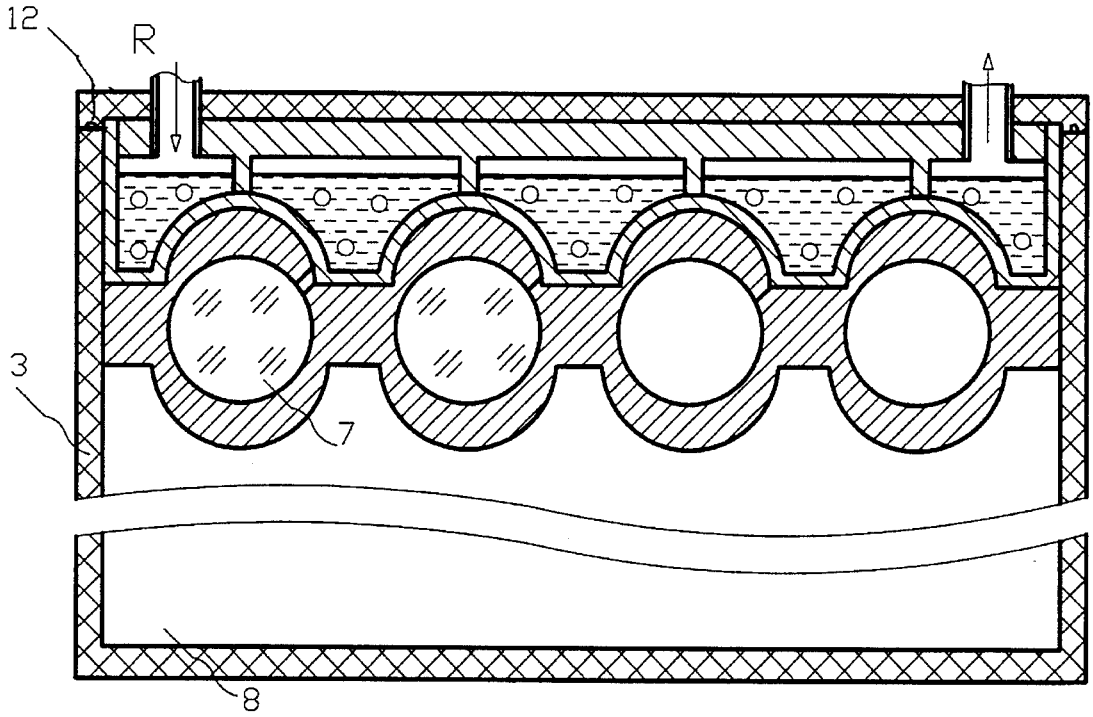
Figure 15D:
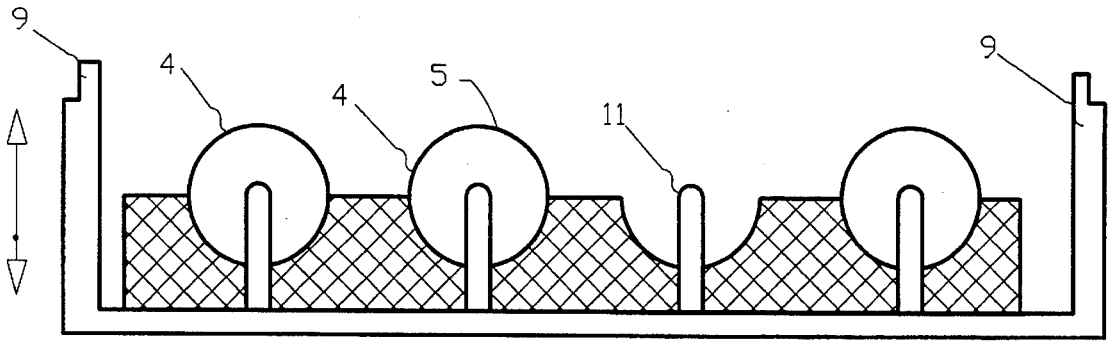
Figure 15E:
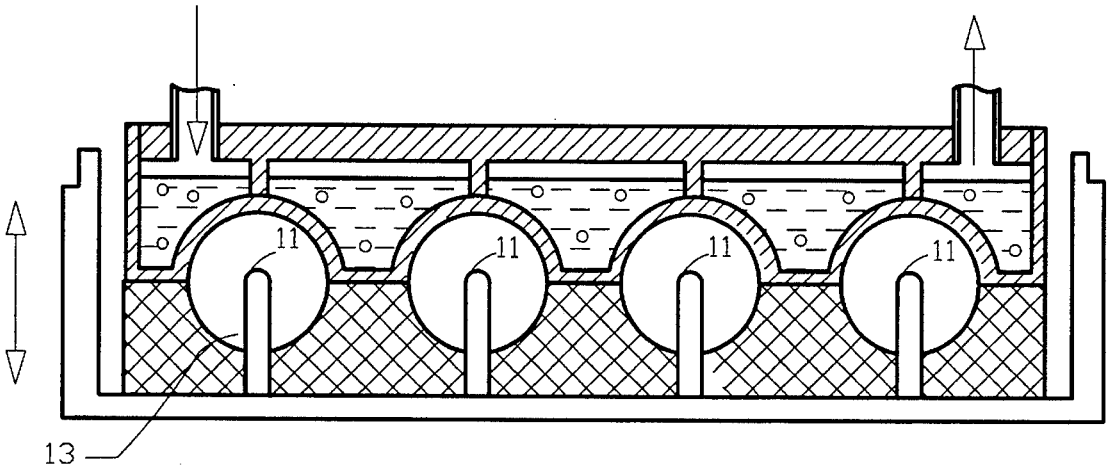
Figure 15F:
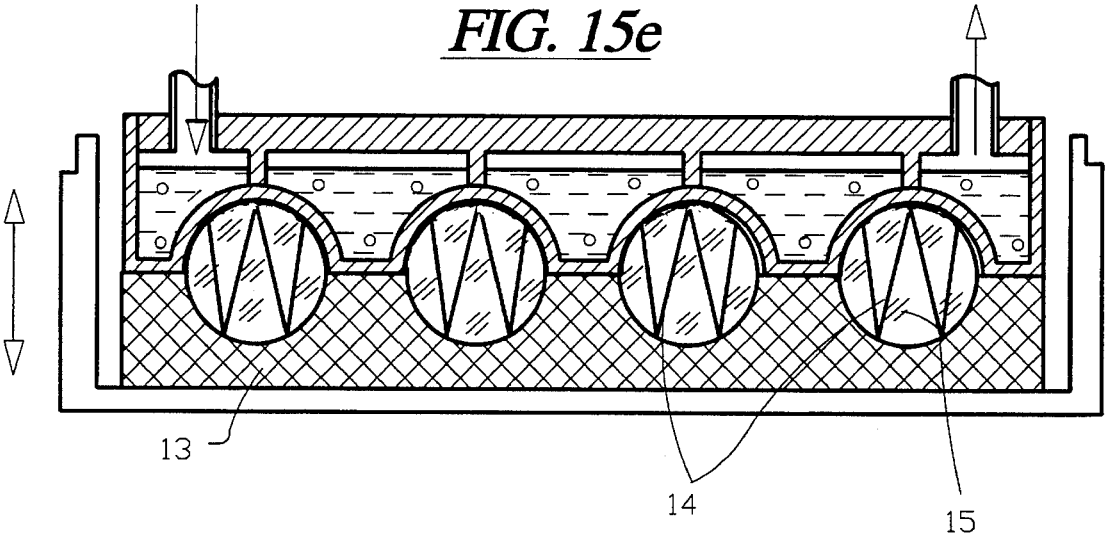

A second variant of modular disassembling cooling chamber which shows in FIG. 15*a* a base module-freezer or refrigerant evaporator, in FIG. 15*b* an upper part of the chamber, in FIG. 15*c* a base freezer connected with the chamber, FIG. 15*d* module for arranging cans to be cooled, in FIG. 15*e*, the module with the cans connected with the base freezer, in FIG. 15*f* the base module freezer connected with the module with the cells provided with a separating spring and filled with water in the mode of ice freezing. It has passages for refrigerant in evaporator 1, an evaporating housing 2, a thermal insulation 3, contact surfaces formed as semi-cylinders 4, an anti-adhesive heat conducting layer (tetrafluorethylene with filler) 5, inner ribbing of the chamber 10, cold accumulator 7, a working chamber 8, braces of the connecting device 9, fixators of the cans on the module 11, a seal 12, cans 13, an anti-adhesive separator from freezing of the food ice 14, wherein 15 is bars of ice.

The lower surface of the base module-freezer 15*a* is provided with depressions formed as semi-cylinders with a diameter corresponding to the diameter of the standard metal cans to be cooled. The upper location of the cooling surface contributes to intensification of cooling due to the transfer of cold during the natural convection downwardly. The same depressions are formed on the module 15*d* for the cans, and the upper or lateral part of the cooling chamber 8 is provided with corresponding pairs of depressions formed as semi-cylinders. During connection and mechanical tightening of the base module 15*a* with the chamber 15*c*; with the module for the cans 15*f*, heat is efficiently withdrawn through the contacting surfaces of the adjoining semi-cylinders. Contact stresses on the compressed surfaces are increased due to the effect of mechanical wedging between the surfaces. During assembly of the base module freezer 15*a* with the module-tray 15*d* in which instead of the cans water are poured, food ice 15 is quickly frozen in the depressions. For increasing the water freezing flat zig-zag shaped spring separator 14 can be introduced into the depressions and formed from a springy strip material with anti-adhesive coating. During the process of freezing of water, the elements of the spring perform the functions of ribs so as to intensify heat withdrawal from water. The spring introduced into the depressions in a compressed state after release together with the ice block in which it is frozen is relaxed so as to separate the ice block into fragments of small section.

Depressions which are to be filled with an additional heat carrier can fill depressions located under the contact surfaces 4 in the cover of the chamber and freezes in the depressions during the period of contact freezing by the freezer "a". After separation of the chamber 4 from the freezer 8 (or after the interruption of refrigerant supply to the freezer), cold accumulated by the heat carrier frozen in the accumulator 7 is used for maintaining a low temperature in the chamber. Such a heat carrier can be for example water-salt solutions (freezing temperature −20°—25° C.) some refrigerant (R 113 has a freezing temperature of −37° C.). The cavities of the accumulator 7 can be formed as cylindrical chambers with sizes of standard cans for beverages. In this case they also can be used for cooling of cans. The removable chamber 8 can be provided with a not shown heat insulating cover which insures long term autonomous operation of the cooling chamber with low supply of heat from outside. The internal ribbing of the upper, heat receiving surface of the chamber can be unified with the external contact semi-cylindrical projections. The base surface of the freezer during the non-working period can be protected with a thermal insulating cover. The device for connecting the freezer and the module with the cans can be provided with a device for automatic disconnection and removal of the freezer when the temperature of the object to be cooled is reached.

FIGS. 16 *a, b, c, d, e, f, g* shows a third variant of modular disassembling chamber-freezer. It shows in FIG. 16*a* a base module-freezer with passages of refrigerant evaporator, in FIGS. 16*b, c* a device for contact cooling of cans based on the module freezer 16*a*, in FIGS. 16*d, e* a device formed as a module freezer connected with the autonomous mobile cold accumulating chamber, in FIGS. 16*f, g* the base module freezer in the device for express freezing of ice, and in FIG. 16*h* a variant for use the module freezer for simultaneous cooling of seven thins. It has passages of refrigerant evaporator of the base module freezer 1, an evaporator housing 2, a thermal insulation 3, a semi-cylindrical heat receiving element 4, an anti-adhesive layer 5, a central passage for refrigerant supply 6, sections for cold accumulations 7, a working cooling chamber 8, a tightening bandage 9, tightening springs 10, a catch of the tightening device 11, a deformable thermo-sensitive element such as bimetallic element or an alloy with memory 12, cans to be cooled 13, cold accumulators formed as cylinders 14, pressing springs 15, an inner ribbing of the cold accumulator 16, a heat carrier of the cold accumulator 17, a guiding cone 18, an external ribbing of the cold accumulators 19, a vessel for freezing of food ice 20, an additional central passage of a multi-section freezer 21, wherein 22 is ice.

Figure 16A:
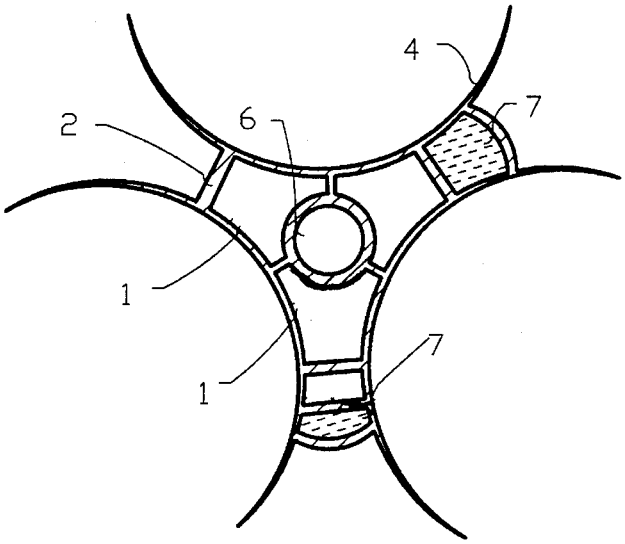
FIGS. 16*a, b, c, d, e, f, g, h* are views showing a set of a cooling equipment based on a contact cooler with longitudinal contact surfaces.
Figure 16B:
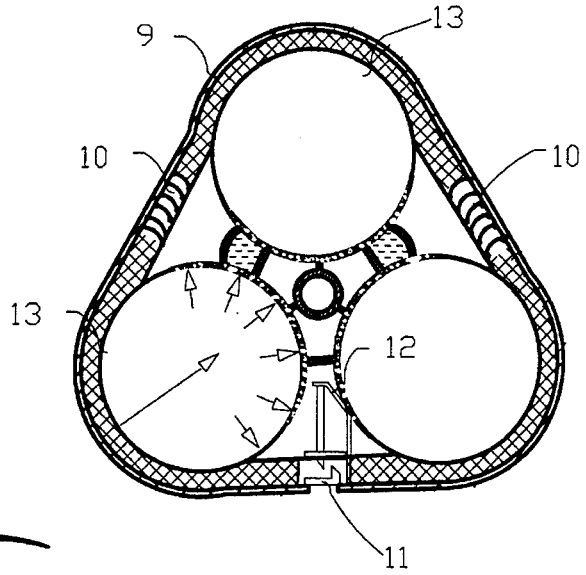
Figure 16C:
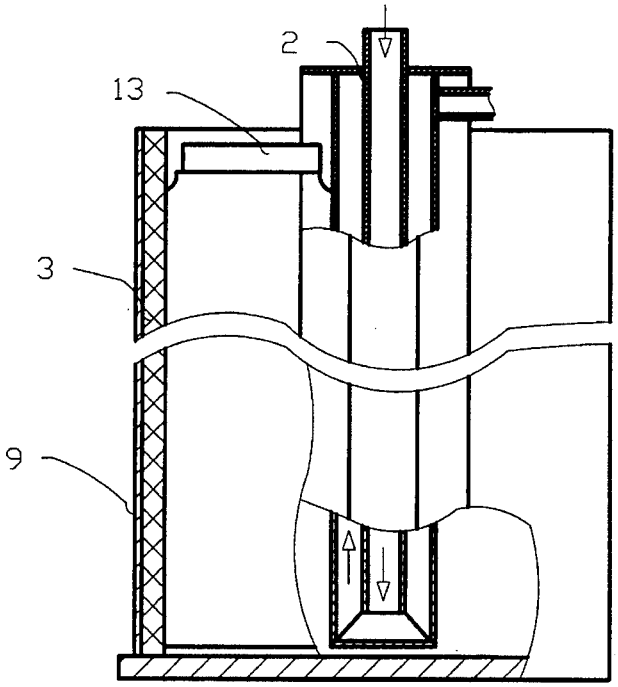

The base module freezer FIG. 16*a* is formed as a pipe with a complicated profile having longitudinal contact semi-cylindrical heat receiving ribs or chutes which form supports for mounting the cylindrical objects to be cooled for example cans. The sickle-shape of the profile for such ribs is an optimal one. The shape provides the most efficient heat exchange with the lowest heat capacity of the device mass. The adjoining and connected parts of the semi-cylinders 4 form a closed passage for the boiling refrigerant or the housing of the evaporator 2 itself. A passage 6 can be arranged inside the passage-housing of the evaporator 2 and connects with the passage 2 only from one side. At the other side the passages 2 and 6 extend outwardly and end in pipes for supply of liquid refrigerant and withdrawal of its vapors into the circuit of the cooling device. The housing of the evaporator 2 can also have closed passages 7 for cold accumulating materials. The passages 7 can be closed from their ends and in this situation they form closed cavities—cold accumulators. When the above described module-freezer "a" is used for cooling the cans 3, they are installed into the heat receiving elements 4, and the bandage which tightens the whole package is placed above the cans. The tightening force is regulated by the springs 10. The bandage is fixed in the straight condition by the lock 11. The force of compression of cans is distributed over the surface contact of the cans 13 with the heat receiving elements 4. The contact stresses which are distributed over the surface provide a tight abutment and a minimal value of thermal resistance of the contacting zone and therefore lead to fast and efficient cooling of cans. The elastic heat exchange film on the surface of the heat receiving elements also contributes to this. A layer of liquid (water which has a thickness of only fractions of a millimeter and provided on the contacting surfaces) smoothes micro-roughness and also contributes to the improvement of the heat contact.

The thermo-sensitive element 12 is arranged so as to provide good heat contact with the elements to be cooled. In the shown construction its one end is connected to the rear in operative surface of the heat receiving element 4. During cooling the element 12 is bent so as to pull the catch 11. After cooling the device to the given temperature the catch is automatically open, the bandage 9 is compressed by the springs 10 and removed from the surfaces of the cans 13. Additional not shown catches can separate the cans 13 in this moment from the chutes with the use of potential energy of the stretched springs 10. After this the cans are freely lowered to a not shown tray. When it is necessary to provide a longer pulling and storage-of the cans 13 at low temperature, the device of automatic separation of the cans is switched of and the accumulator 7 accumulates during the short period of separation of the refrigerant the quantity of cold required for long cooling.

With this construction of the base module-freezer the most rational use of the metal is obtained. Minimal metal-consumption of the device provides the fastest start of freezing mode and cooling. During this process minimal temperatures are provided in the central part of the symmetrical heat exchanging pack while the peripheral part of the assembly evaporator-cans is cooled only at the end of the operation. Combined with the minimum possible surface of the heat exchange with the ambient atmosphere, this construction provides maximum energy efficiency with minimal cold losses to the ambient air and minimum mass and size.

Figure 16D:
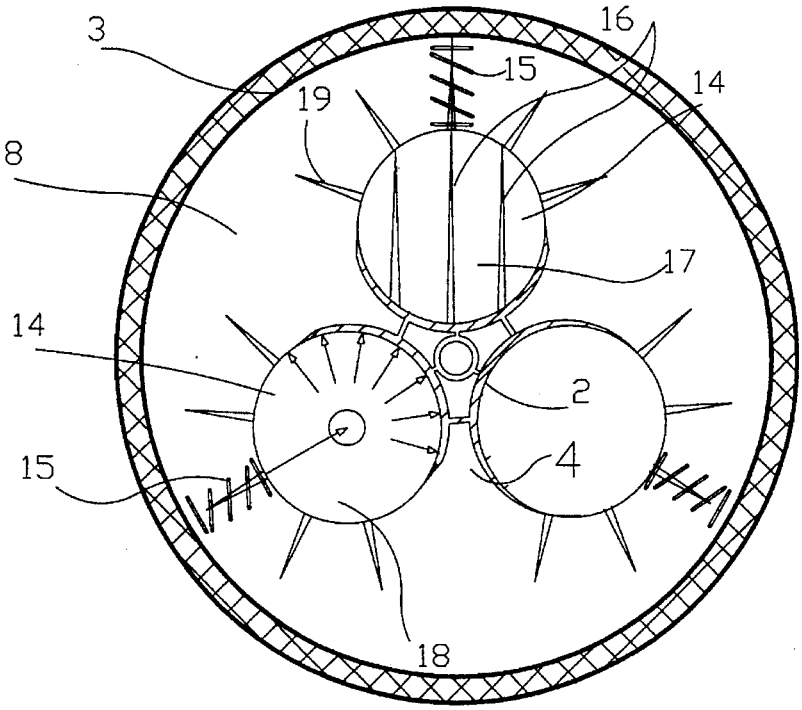
Figure 16E:
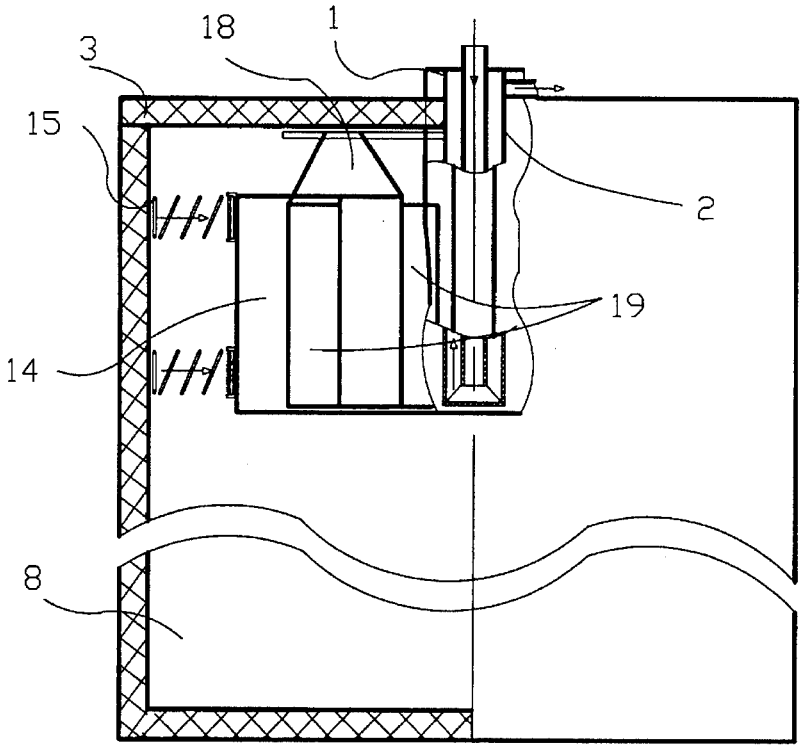

The base module-freezer is used also as the main evaporator-cooler of autonomous mobile cooling chamber FIGS. 16*d, e*. For this purpose the module-freezer is introduced into the upper part of the chamber through the sealed opening. When it is necessary to use the chamber for long time in the autonomous mode without the connection with the main cooling device, cold accumulators 14 are arranged inside the chamber 8 on the radial spring compressible elements 15. They are formed as cylindrical cans 13 with guiding cones 18 at their ends. During the introduction of the freezers into the chamber 8, the cones 18 engage in the chutes 4 and guide the cold accumulators into the chutes as well. The cold accumulators pressed in the radial direction by the springs 15 assume in the chutes-heat receiving elements the places of the cans for cooling the cans. Liquid frozen in the cold accumulators 14 accumulates cold which is used after the interruption of the refrigerant evaporation in the module-freezer and removal of the same from the chamber 8. The efficient freezing of the heat carrier 17 at low gradients of temperatures is provided by the internal ribbing of the walls of the cans of the cold accumulators 16 which extend through the heat carriers 17. The efficient cooling of the space in the chamber 8 is performed by the external ribbing 19 of the cylindrical housing of the cold accumulators 16 from the side which does not adjoin the cylindrical surface of the chutes-heat receiving elements 4.

Figure 16F:
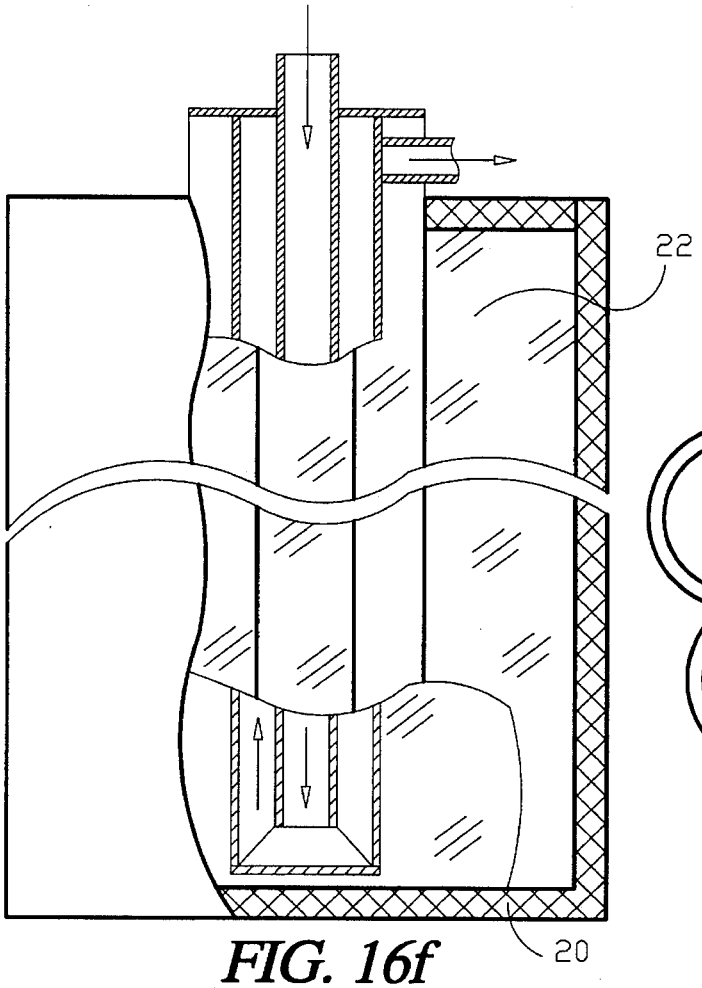

For freezing-on ice, the base module-freezer is introduced into a bag of a polymeric film or a vessel with the walls having the anti-adhesive coating 20 shown in FIGS. 16*f, g*.

The vessel can be made for example from polyethylene. The diameter of the vessel 20 corresponds to the size of the evaporator-freezer "a". During freezing water is frozen on the surfaces of evaporator-freezer so as to form longitudinal column bars of corresponding cross-section. Then the supply of refrigerant is switched off, the vessel is removed from the freezer and the ice is removed in a known way. For example, heat provided by compressed refrigerant vapors in the condenser can be used. Also, a separate passage can be provided in the section of the freezer as shown in FIG. 16*a*. An electric heating element or a small heat exchanger heated by air can be connected to the freezer. Additional periodic projections and recesses can be also provided on the inner surface of the vessel 20. In this case ice structures of smaller sizes and corresponding shapes, for example cubes, balls, etc. can be made.

Figure 16H:
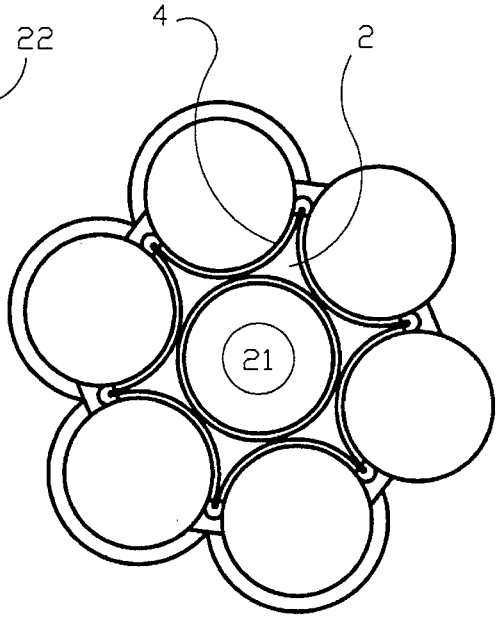
Figure 16G:
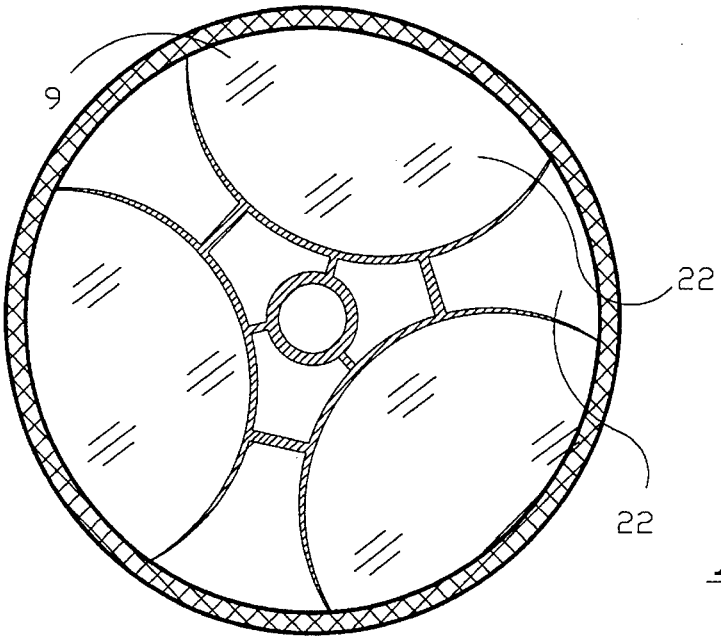

A variant of a multi-element freezer shown in FIG. 16*h* has six longitudinal chutes-heat receiving elements 4 which are uniformly located over the perimeter. It can simultaneously cool up to seven cans, with the seventh can located in the central cavity of the corresponding size. The central cavity can also be used for freezing-on of cylindrical or conical rods of ice.

Figure 17A:
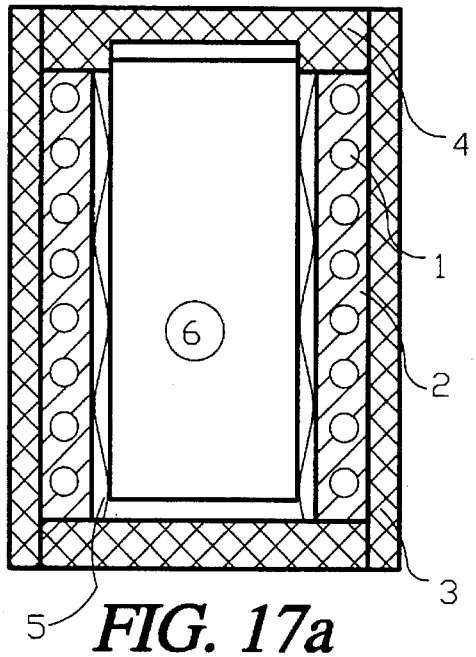
FIGS. 17*a, b,* 18*a, b* are views showing a cooling and cold accumulating adaptors.
Figure 18B:
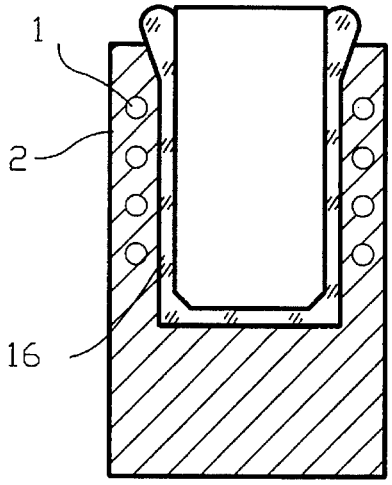
Figure 17B:
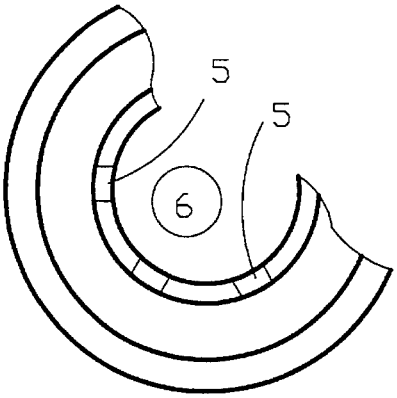

Another variant of the cooling chamber for accelerated conductive cooling of solid objects is shown in FIG. 17. A cylindrical coil-evaporator of the refrigerant 1 is formed of one piece with the cylindrical metal body 2 of the evaporator. The cylindrical block of the evaporator can be formed as a cast element with the coil 1 welded or soldered to the hollow metal cylinder 2. Elastic spring heat receiving elements are connected to the inner cylindrical surface of the body 2 by welding, soldering, riveting, etc., and formed of an elastic material having high heat conductivity. For example they can be formed as zig-zag shaped wavy strips from a sheet elastic bronze connected to the inner generatrices of the cylinder 2. The diameter of the circle of projections of such springs is smaller than the diameter of the corresponding size of objects to be cooled by the value of elastic deformation of the springs 5 in assembled condition. When the diameter of the object is 50–100 mm, the height of the spring is 3–7 mm and the thickness of the spring material 0.5–0.6 mm, the radial deformation of the springs is 0.4–1.2 mm. The working surfaces of the spring 5 which are in contact with the surface of the object 6 to be cooled can also be covered with a thin layer of the anti-adhesive heat conductive material 7 which is analogous to the material used for coating of contact surfaces of disassembleable cooling chamber of FIG. 17. The body 2 with the coil 1 are covered with an external layer of heat insulation 3, and the ends are heat insulated by covers 4 which can automatically cover the volume inside the cylinder 2 with the object 6 accommodated in it when the system is in the cooling mode.

The system shown in FIGS. 17*a, b* can be also used for heating of the object 6 as well. In this case instead of the coil 1 for cold generation, one of the known sources of thermal energy is used, such as for example an electrical heating spiral, a coil with a heating heat carrier, fuel elements, a burning device, etc. Heatable objects 6 can have a shape of a body of revolution as well as any other shape. In this case the body 2 with the spring elements inside has a corresponding inner configuration. When the object 6 has complicated shapes, the body 2 can have two-halves which are connected with one another and tightened together with the object 6.

Figure 18A:
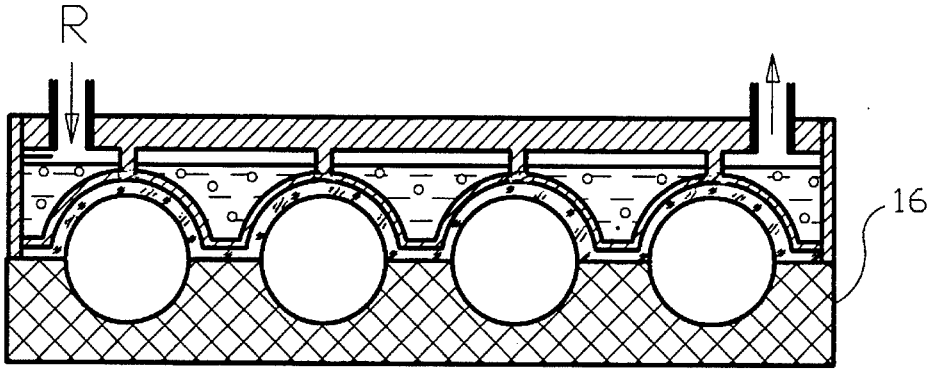

The cooling device shown in FIGS. 18*a, b* has a base cooling surface with cavities for boiling refrigerant. Its construction is similar to the construction of FIG. 15. The difference is that here it is possible to adjust the shape of the surface to the complicated shape of the object with tight abutment and contact of the surfaces. A layer of polymer anti-adhesive film is mounted on the solid cooling surface. A gap between the film and the metallic surface is sealed at the perimeter and filled with the heat conductive liquid, for example salt solutions, ethyleneglycols, etc. The liquid intermediate layer provides for a tight abutment to the object and accumulation of cold.

Figure 19:
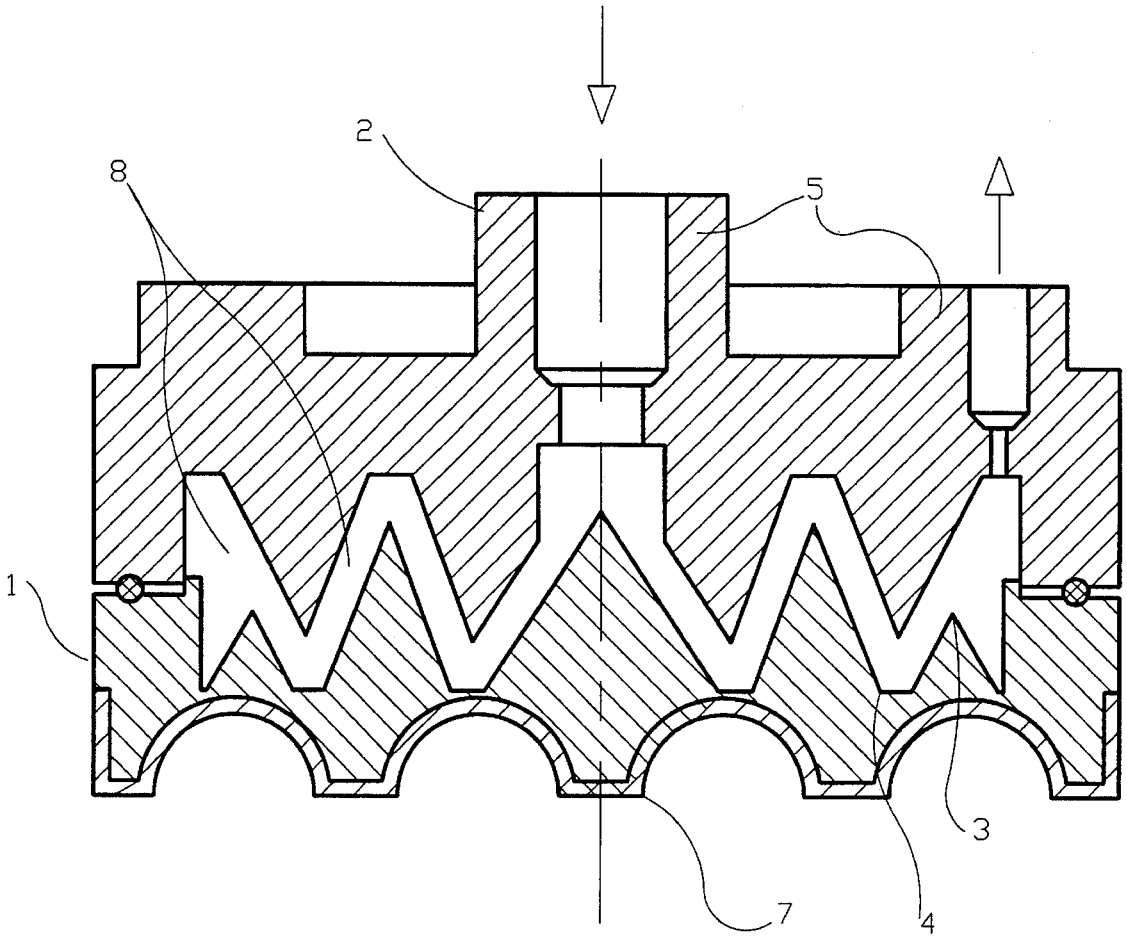
FIG. 19 is a view showing the intensified refrigerant evaporator.

A modification of the intensified refrigerant evaporator which can be used both in the main loops of the cooling device and in the auxiliary loops of the thermo-syphon cold accumulators is shown in FIG. 19. In order to intensify the heat transfer from the walls of the evaporator to the boiling refrigerant, the bottom 1 and the cover 2 of the evaporator body are provided with projections 3 and depressions 4 which alternate with one another so that the projections of one of the parts 1 engages in the depressions of the other part 2 with gaps therebetween. The gap 8 between the adjoining parts forms a guide for the evaporating refrigerator. Frequent sharp changes of the flow and small sizes of the main configuration (gap size 0.3–1.6 mm) prevent forming of a crisis of refrigerant boiling and provide high intensification of heat transfer during the refrigerant boiling. Pipes for supply and withdrawal of heat carrier flows are provided in the center and over the periphery of the adjoining parts. The heat exchange surface of this apparatus is 3–4 times higher than the surface of the known apparatus of the same size.

Figure 14B:
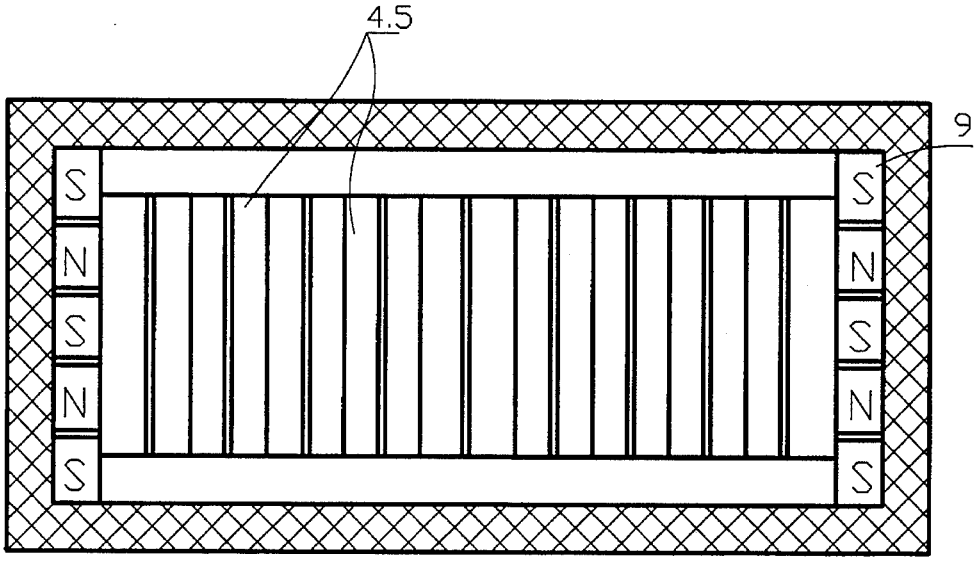

The thermo-syphon cold accumulators which form elements of the cooling chamber shown in FIG. 14 can be used as independent sectional devices for cold withdrawal. A condenser of such a cold accumulator-thermo-syphon is in the thermal contact with the sectioned load evaporator of the cooling device, while the evaporator is in contact with the freezing-out cold carrier which is heated by the object or chamber. The substance for freezing out in the loop of the cold accumulator is selected in accordance with the working level of temperatures. The temperature of solidification-melting of the heat carrier must be lower than the working temperature of the thermo-stating by the value of under-recuperation by 2°–6°. For example for accumulation and use of cold at the level of –30°—35° C. it is possible to use chladon R-13 (freezing temperature –36.6° C.), while at the level of +2°–+5° C. water can be utilized.

Utilizing of these cold accumulators which are arranged in the sequence of increase in temperature of solidification of the heat carrier in the sections of the device shown in FIG. 3, gives possibility to realize of the mode of stable consumption of cold.

It will be understood that each of the elements described above, or two or more together, may also find a useful application in other types of constructions differing from the types described above.

While the invention has been illustrated and described as embodied in a cooling device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A method of producing a high temperature cold in a first stage and a low temperature cold in a second stage, comprising the steps of compressing vapors of refrigerant in said first stage and in said second stage by a single compressing means; condensing the vapors of refrigerant in said first stage and in said second stage; expanding the compressed condensed refrigerant and its subsequent evaporation with transfer of cold to objects to be cooled in said first stage and in said second stage; and during periods of reduction in a demand for generation of high temperature cold in said first stage using the high temperature cold generated in said first stage for condensing the vapors in said second stage for generating low temperature cold.

2. A device for producing high temperature cold and low temperature cold, comprising a first stage for generating high temperature cold and a second stage for generating low temperature cold, said first stage for generating high temperature cold including first means for compressing vapors of refrigerant, first means for condensing the vapors, first means for expanding the compressing, condensed refrigerant, and first means for subsequent evaporation of the refrigerant with transfer of cold objects to be cooled, said second stage for generating low temperature cold including second means for condensing the vapors, second means for expanding the compressed condensed refrigerant, and second means for its subsequent evaporation with transfer of cold to objects to be cooled, said first and second stage being connected so that during periods of reduction and a demand for generation of high temperature cold in said first stage, cold produced in said first stage is supplied to said second condensing means for condensing the vapors of refrigerant in said second stage.

3. A device for producing high temperature cold and low temperature cold, comprising a first stage for generating high temperature cold and a second stage for generating low temperature cold, said first stage for generating high temperature cold including first means for compressing vapors of refrigerant, first means for condensing the vapors, first means for expanding the compressing, condensed refrigerant, and first means for subsequent evaporation of the refrigerant with transfer of cold objects to be cooled, said second stage for generating low temperature cold including second means for condensing the vapors, second means for expanding the compressed condensed refrigerant, and second means for its subsequent evaporation with transfer of cold to objects to be cooled, said first and second stage being connected so that during periods of reduction and a demand for generation of high temperature cold in said first stage, cold produced in said first stage is supplied to said second condensing means for condensing the vapors of refrigerant in said second stage, said connecting means including means for switching flows of the refrigerant from said first stage to said second stage so that said first evaporating means of said first stage become said second condensing means of said second stage; and means for reducing pressure of said second stage.

* * * * *